US007183888B2

(12) United States Patent
Kanno et al.

(10) Patent No.: US 7,183,888 B2
(45) Date of Patent: Feb. 27, 2007

(54) HIGH-FREQUENCY CIRCUIT

(75) Inventors: Hiroshi Kanno, Osaka (JP); Kazuyuki Sakiyama, Shijonawate (JP); Ushio Sangawa, Ikoma (JP); Tomoyasu Fujishima, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 64 days.

(21) Appl. No.: 10/969,096

(22) Filed: Oct. 21, 2004

(65) Prior Publication Data

US 2005/0077993 A1 Apr. 14, 2005

Related U.S. Application Data

(63) Continuation of application No. PCT/JP04/04759, filed on Apr. 1, 2004.

(30) Foreign Application Priority Data

Apr. 24, 2003 (JP) ..... 2003-120024

(51) Int. Cl.
*H01F 5/00* (2006.01)

(52) U.S. Cl. ..... 336/200

(58) Field of Classification Search ..... 336/65, 336/83, 200, 205–208, 232
See application file for complete search history.

(56) References Cited

U.S. PATENT DOCUMENTS 3,833,872 A * 9/1974 Marcus et al. ..... 336/83
4,959,631 A * 9/1990 Hasegawa et al. ..... 336/83
6,198,374 B1 * 3/2001 Abel ..... 336/200
7,030,725 B2 * 4/2006 Ahn et al. ..... 336/200

FOREIGN PATENT DOCUMENTS

| | | |
|---|---|---|
| JP | 5-14009 | 1/1993 |
| JP | 7-336104 | 12/1995 |
| JP | 11-274416 | 10/1999 |
| JP | 2000-91805 | 3/2000 |
| JP | 2002-9516 | 1/2002 |

OTHER PUBLICATIONS

Inder Bahl et al., Microwave Solid State Circuit Design 2nd Edition pp. 275 Wiley-Interscience, 2003, no month.
Sutono et al., IEEE Radio Frequency Integrated Circuits Symposium Digest, "Development of Three Dimensional Ceramic-Based MCM Inductors for Hybrid RF/Microwave Applications", pp. 175-178, 1999, no month.
Hejazi et al., IEEE Transactions on Applied Superconductivity, "Compact Superconducting Dual-Log Spiral Resonator With High Q-Factor and Low Power Dependence", vol. 12, No. 2, 2002, no month.
Sutono et al., IEEE EPEP Digest, "Investigations of Multi-Layer Ceramic-Based MCM Technology", pp. 83-86, 1998, no month.

* cited by examiner

*Primary Examiner*—Tuyen T. Nguyen
(74) *Attorney, Agent, or Firm*—Wenderoth, Lind & Ponack, L.L.P.

(57) ABSTRACT

A high-frequency circuit is formed on a multilayered dielectric substrate having at least two conductive circuit layers. The high-frequency circuit includes: a first spiral conductive strip formed in the first conductive circuit layer, the first spiral conductive strip having at least one turn; and a second spiral conductive strip formed in a second conductive circuit layer which is different from the first conductive circuit layer, the second spiral conductive strip having at least one turn and not being in electrical conduction with the first spiral conductive strip. The first spiral conductive strip and the second spiral conductive strip, located at different levels, overlap each other. The first spiral conductive strip has a rotating direction opposite to a rotating direction of the second spiral conductive strip.

16 Claims, 20 Drawing Sheets

HIGH-FREQUENCY CIRCUIT

This application is a continuation of International Application PCT/JP04/04759, filed Apr. 1, 2004.

BACKGROUND OF THE INVENTION

1. Field of the Invention

The present invention relates to a high-frequency circuit which is capable of transmitting or radiating a high-frequency signal in the microwave or millimeter range, and more particularly to a high-frequency circuit capable of exhibiting resonance.

2. Description of the Background Art

In recent years, wireless communication devices have made advancements in terms of downsizing and high-functionalization, which have enabled the drastic prevalence of cellular phones. In the years to come, further downsizing, high-functionalization, and cost reduction are expected.

A high-frequency circuit which is mounted in a wireless communication device such as a cellular phone requires a resonator as an element for composing circuits such as filters, an antenna, and the like.

For example, a ½ wavelength resonator composed of a transmission line whose both ends are open terminated may be used as a resonator. FIG. 25A is an upper plan view showing a conventional ½ wavelength resonator. FIG. 25B is a cross-sectional view of the conventional ½ wavelength resonator shown in FIG. 25A.

A ½ wavelength resonator which is composed of a transmission line 900 whose both ends are open terminated as shown in FIG. 25A needs to be as long as 7.5 cm in the case where its resonance frequency is 2 GHz. Therefore, in order to reduce the circuit size, it is necessary to somehow reduce the resonator length. It is generally known that using a material with high dielectric constant for the circuit substrate 901 can reduce the length of the open-ended transmission line 900, and hence the size of the resonator composed thereof.

On the other hand, it is also generally known that, when a plurality of resonators composed of transmission lines are electromagnetically coupled, the lowest-order resonance frequency thereof can be reduced. FIG. 26A is an upper plan view showing a conventional resonator in which two resonators are electromagnetically coupled together. FIG. 26B is a cross-sectional view of the conventional resonator shown in FIG. 26A composed of two electromagnetically coupled resonators. As disclosed in Document 1 (Microwave Solid State Circuit Design 2nd Edition pp. 275 Wiley-Interscience 2003), if two resonators are coupled together with a short distance between two parallel coupled-lines 902 and 903 contained therein, resonance will no longer occur at a resonance frequency f0 at which resonance would have occurred in the case where there was only a single resonator. Instead, an even mode resonance at a resonance frequency f1 (where f1<f0) and an odd mode resonance at a resonance frequency f2 (where f2>f0) will occur. The more strongly the two resonators are coupled, the farther away the values of f1 and f2 will shift from the value of f0. Therefore, by realizing a stronger coupling between two resonators which have a resonance frequency of f0, a resonator which resonates at a lower resonance frequency f1 (i.e., with a longer wavelength) can be provided; that is, for a given resonance frequency, a resonator having a shorter resonator length can be realized than in the case of employing a single resonator.

However, substrate materials having high dielectric constant are more expensive than substrate materials having low dielectric constant, e.g., resin. Therefore, the aforementioned technique of downsizing a resonator by using a material with high dielectric constant for the circuit substrate leads to cost problems, regardless of whether the entire circuit is formed by using a substrate of a material with high dielectric constant or only the resonator portion is formed of a material with high dielectric constant.

On the other hand, in order to shift the resonance frequencies by introducing a higher degree of coupling between two parallel coupled-lines contained in two resonators, the distance between the parallel lines must be made very short, which means that a drastic improvement in strip formation precision is necessary. However, given the current demands for reducing costs associated with production processes, it is not realistic to improve strip formation precision just for the sake of realizing an extreme reduction in the distance between parallel lines of a resonator. Thus, it would be unrealistic to provide a resonator having a short resonator length by reducing the distance between parallel coupled-lines.

Therefore, what would be practical is to provide a downsized resonator by using a circuit structure which is applicable to a semiconductor process, a production process for a low-temperature sintered ceramic substrate, a multilayer circuit process for a resin substrate, or the like.

It is possible to obtain a high degree of coupling between parallel coupled-lines by deploying two transmission lines in multiple layers, such that the transmission lines overlap each other in the thickness direction. FIG. 27 is a cross-sectional view showing a conventional resonator having an enhanced coupling degree, in which two transmission lines 904 and 905 are disposed in multiple layers so as to overlap each other in the thickness direction. However, the technique illustrating FIG. 27, where two transmission lines are disposed in multiple layers so as to overlap each other in the thickness direction has the following two problems.

A first problem is that there is a limit to the reduction in resonance frequencies that can be achieved based on the capacitance obtained by the parallel overlapping of the two transmission lines 904 and 905. No matter how strong an electromagnetic coupling is obtained by the above technique, the new resonance frequency f1 will not be much below the fundamental frequency f0. This technique is only effective for causing a resonance in the case where the length of the coupled-lines is ½ of the wavelength of the electromagnetic waves. Thus, the length of the coupled-lines is still required to be about ½ of the wavelength, which is a limitation to downsizing.

A second problem is that the resonance obtained from parallel coupled-lines cannot provide adequate spurious prevention characteristics. For example, a band-pass filter used in an actual communication device needs to have not only passing characteristics for a desired band and blocking characteristics for frequencies in the immediate neighborhood of the desired band, but also spurious prevention characteristics for removing harmonic components which may have occurred in various active elements in a previous block. A resonator which is based on parallel coupled-lines is not entirely suitable for use in a communications module since it is impossible to control a resonance which occurs at a frequency which is twice the fundamental frequency.

SUMMARY OF THE INVENTION

Therefore, an object of the present invention is to provide a compact resonator having a simple structure which is much shorter than the wavelength of electromagnetic waves of a transmission band and which does not resonate at a frequency about twice a fundamental resonance frequency, the resonator not requiring additional use of any special material. A further object of the present invention is to provide a compact filter circuit having a blocking function for a frequency which is twice a transmission frequency.

The present invention has the following features to attain the object mentioned above.

The present invention is directed to a high-frequency circuit formed on a multilayered dielectric substrate having at least two conductive circuit layers, comprising: a first spiral conductive strip formed in the first conductive circuit layer, the first spiral conductive strip having at least one turn; and a second spiral conductive strip formed in a second conductive circuit layer which is different from the first conductive circuit layer, the second spiral conductive strip having at least one turn and not being in electrical conduction with the first spiral conductive strip, wherein, the first spiral conductive strip and the second spiral conductive strip, located at different levels, overlap each other, and the first spiral conductive strip has a rotating direction opposite to a rotating direction of the second spiral conductive strip.

In the high-frequency circuit according to the present invention, an overlapping coupling capacitance which couples the first spiral conductive strip and the second spiral conductive strip exists near a portion where the first spiral conductive strip and the second spiral conductive strip, located at different levels, overlap each other. As a result of a first high-frequency current flowing through the first spiral conductive strip being transferred to the second spiral conductive strip via an overlapping coupling capacitance, a second high-frequency current flows through the second spiral conductive strip. When a coupling occurs such that the direction in which the second high-frequency current flows in the same direction as that of the first high-frequency current, the overlapping portion between the first spiral conductive strip and the second spiral conductive strip can be regarded as parallel coupled-lines in which an even mode is induced so that currents will flow in the same direction. The second high-frequency current which flows along the second spiral conductive strip can further move to the first spiral conductive strip via an overlapping coupling capacitance. Thus, the high-frequency circuit according to the present invention can function as a resonator which exhibits resonance for electromagnetic waves of an elongated wavelength beyond its physical size. Since a capacitance circuit in itself functions as a high-pass filter, in order for the high-frequency circuit according to the present invention to exhibit resonance at a lower resonance frequency, an advantageous arrangement would be where a high-frequency current flowing through the high-frequency circuit according to the present invention will travel via an overlapping coupling capacitance by a minimum number of times, so that the first and/or second spiral conductive strips are efficiently utilized for effectively increasing the resonator length. Therefore, by ensuring that the first spiral conductive strip and the second spiral conductive strip have opposite rotating directions, it becomes possible to obtain resonance at a reduced resonance frequency.

With respect to the resonance at the fundamental frequency in the high-frequency circuit, the open ends of the outermost strip subportions of both spiral conductive strips can be considered as open ends of the entire structure. Therefore, a zero current distribution density exists at such open terminating ends. On the other hand, in the high-frequency circuit according to the present invention, currents flowing through the spiral conductive strips mutually transfer via an overlapping coupling capacitance between the spiral conductive strips, so that a zero current distribution density cannot exist near the overlapping portion between the spiral conductive strips. Similarly, in order for a signal having a wavelength corresponding to a frequency which is twice the frequency at which a fundamental mode resonance occurs to exhibit resonance, it is necessary that the open ends of the outermost strip subportions of both spiral conductive strips correspond to the open ends of the entire structure, and also that a zero current distribution density exits near an overlapping portion between the spiral conductive strips. However, since the spiral conductive strips no longer function as individual spiral conductive strips but can only exhibit resonance utilizing a coupling between the spiral conductive strips, the condition that a zero current distribution density should exit near an overlapping portion between the spiral conductive strips cannot be satisfied. It is at a frequency which is three times the fundamental frequency that the resonating conditions are satisfied without a zero current distribution density existing in the neighborhood of the overlapping portion between the two spiral conductive strips when a zero current distribution density exists at the open terminating ends of the outermost strip subportions of the spiral conductive strips. Note that, in order to obtain this effect according to the present invention, the two spiral conductive strips should not be mechanically connected by through-vias or the like.

Thus, there is provided a low-cost but highly-functional resonator which is more compact than conventionally, and which can be constructed based on a simple structure without requiring any special material, such that the high-frequency circuit does not exhibit resonance at a frequency which is twice the fundamental resonance frequency, and structured in a size which is much shorter than the wavelength of electromagnetic waves of a transmission band.

Preferably, the multilayered dielectric substrate has three or more conductive circuit layers, the high-frequency circuit further comprising: at least one third spiral conductive strip formed in a third conductive circuit layer which is different from the first and second conductive circuit layers, the third spiral conductive strip having at least one turn and not being in electrical conduction with the first and second spiral conductive strips, wherein, the at least one third spiral conductive strip overlaps the first and second spiral conductive strips at respectively different levels, and any adjoining spiral conductive strips among the first to third spiral conductive strips have opposite rotating directions to each other.

According to the above structure, due to a current flowing through the first spiral conductive strip, a magnetic field is generated in a direction which perpendicularly cuts through the center of the first spiral conductive strip. The magnetic field thus generated also cuts perpendicularly through the center of the overlapping second spiral conductive strip. Since a capacitance which couples the first spiral conductive strip and the second spiral conductive strip is generated in an overlapping portion, a current flows through the second spiral conductive strip in the same direction as in the first spiral conductive strip. A magnetic field which lies perpendicularly across the conductive circuit layer in which the second spiral conductive strip is formed also lies across the overlapping third spiral conductive strip. Since a capacitance which couples the second spiral conductive strip and the third spiral conductive strip is generated in an overlapping portion, a current flows through the third spiral conductive strip in the same direction as in the second spiral conductive strip. Thus, a current flows through the third spiral conductive strip in the same direction as in the first spiral conductive strip. This principle also holds true in the case where there are four or more overlapping spiral conductive strips.

In order for a combined structure composed of a plurality of adjoining pairs of spiral conductive strips to function as a resonator having an even longer resonator length, it is necessary that the plurality of adjoining pairs of spiral conductive strips all satisfy the condition for allowing an adjoining pair of overlapping spiral conductive strips to function as a resonator having the longest resonator length. Therefore, the condition for achieving the longest resonator length can be described as the rotating directions being opposite in every adjoining pair of spiral conductive strips.

Thus, according to the present invention, a resonator which is more compact than conventionally can be provided at low cost, based on a simple structure and without requiring any special material.

Preferably, if the first to third spiral conductive strips were to be placed on one another so that a spiral center of each spiral conductive strip coincides, outer peripheries of the first to third spiral conductive strips would coincide with one another.

More preferably, open terminating ends of outermost strip subportions of any two adjoining spiral conductive strips are disposed diagonally opposite from each other with respect to the spiral center of each spiral conductive strip.

In a preferable embodiment, the high-frequency circuit further comprises an input/output line which is directly connected to a portion of an outermost strip subportion of any one of the first to third spiral conductive strips.

Thus, a strong coupling between a compact resonator and an external circuit can be realized by using a simple and compact circuit.

For the sake of simplifying the circuit structure, it is preferable that the spiral conductive strip and the input/output line are formed in the same conductive circuit layer. However, similar effects can also be obtained by disposing the spiral conductive strip and the input/output line in different conductive circuit layers, and electrically connecting the spiral conductive strip and the input/output line via a through-via.

Preferably, the high-frequency circuit further comprises at least one stacked spiral conductive strip resonator formed on the multilayered dielectric substrate, the at least one stacked spiral conductive strip resonator having the same structure as that of a stacked spiral conductive strip resonator composed of the first to third spiral conductive strips, wherein the stacked spiral conductive strip resonators are disposed adjoining one another.

According to the above structure, the two adjoining stacked spiral conductive strip resonators each have a stacked structure, and therefore a spatial capacitance occurs between the stacked spiral conductive strips. In addition, when a current flows through one of the stacked spiral conductive strip resonators, a magnetic field which is generated so as to penetrate through the inside of the stacked spiral conductive strip resonator also closes its magnetic flux on the outside of the stacked spiral conductive strip resonator. Therefore, the magnetic field is in a direction perpendicular to the multilayered dielectric substrate. Consequently, by disposing the other stacked spiral conductive strip resonator so that this ambient magnetic field penetrates through the other stacked spiral conductive strip resonator with a sufficient intensity, a current can also flow through the other stacked spiral conductive strip resonator. Thus, by simply disposing the two stacked spiral conductive strip resonators so as to adjoin each other, a desired inter-resonator coupling can be obtained. Moreover, this advantageous effect of being able to adjust a coupling between the stacked spiral conductive strip resonators based on the distance therebetween can be obtained without requiring any additional processes which may involve the use of a material with high dielectric constant or the like. Therefore, the high-frequency circuit having the above structure can be produced at low cost.

In a preferable embodiment, at least one of the stacked spiral conductive strip resonators includes: a fourth spiral conductive strip formed in the first conductive circuit layer so as to adjoin the first spiral conductive strip, the fourth spiral conductive strip having the same rotating direction as the rotating direction of the first spiral conductive strip and having at least one turn; a fifth spiral conductive strip formed in the second conductive circuit layer so as to adjoin the second spiral conductive strip, the fifth spiral conductive strip having the same rotating direction as the rotating direction of the second spiral conductive strip and having at least one turn; and at least one sixth spiral conductive strip formed in the third conductive circuit layer so as to adjoin the third spiral conductive strip, the at least one sixth spiral conductive strip having the same rotating direction as the rotating direction of the third spiral conductive strip and having at least one turn, wherein the fourth to sixth spiral conductive strips overlap one another at respectively different levels.

Preferably, the high-frequency circuit further comprises a plurality of input/output lines coupled to the respective stacked spiral conductive strip resonators.

The above structure realizes a band-pass filter circuit by utilizing a plurality of stacked spiral conductive strip resonators, each resonator having a resonator length longer than that of each component spiral conductive strip. Since each stacked spiral conductive strip resonator occupies less space than does a conventional planar resonator, the resultant band-pass filter circuit also takes less space than does a band-pass filter circuit which is based on a conventional planar resonator structure. A conventional ½ wavelength resonator composed of a single layer of a planar circuit exhibits resonance also at a frequency which is twice the fundamental wave, a conventional band-pass filter composed of a ½ wavelength resonator would have unwanted passing characteristics in a frequency band which is twice as high as the fundamental frequency. However, in the high-frequency circuit having the above structure, each stacked spiral conductive strip resonator composing the filter circuit in itself has characteristics such that resonance at a frequency which is twice the fundamental wave is suppressed. As a result, there is provided an advantageous effect of inhibiting unwanted passing characteristics in a frequency band which is twice as high as the fundamental frequency. Moreover, the high-frequency circuit having the above structure can be produced at low cost because it can provide advantageous effects such as reduction in the circuit area, and inhibition of unwanted passing characteristics in a frequency band which is twice as high as the fundamental pass band, without requiring any additional processes which may involve the use of a material with high dielectric constant or the like. Therefore, the high-frequency circuit having the above structure can be produced at low cost.

In order to obtain a strong coupling between an external circuit and the stacked spiral conductive strip resonator, it is preferable to obtain a coupling by directly connecting a portion of the spiral conductive strip to a portion of the input/output line.

As a result, not only the efficiency of energy transmission from an external circuit to the stacked spiral conductive strip resonator, or from the stacked spiral conductive strip resonator to an external circuit can be improved, but also broad-band filter characteristics can be obtained.

Preferably, if the first and second spiral conductive strips were to be placed on each other so that a spiral center of each spiral conductive strip coincides, outer peripheries of the first and second spiral conductive strips would coincide with each other.

As a result, the capacitance which couples the first spiral conductive strip and the second spiral conductive strip increases at an overlapping portion between the first spiral conductive strip and the second spiral conductive strip. Therefore, a current transfer via an overlapping coupling capacitance between the spiral conductive strips can occur at an even lower frequency. As a result, a further reduction in the resonance frequency becomes possible, i.e., a more compact resonator can be provided.

More preferably, an open terminating end of an outermost strip subportion of the first spiral conductive strip and an open terminating end of an outermost strip subportion of the second spiral conductive strip are disposed diagonally opposite from each other with respect to the spiral center of the first spiral conductive strip.

Thus, an effective overlapping between the spiral conductive strips can be realized in the outermost strip subportion, which has the longest distance per turn around the spiral center of the spiral conductive strip. Therefore, a current transfer via an overlapping coupling capacitance between the spiral conductive strips can occur at an even lower frequency. As a result, a further reduction in the resonance frequency becomes possible, i.e., a more compact resonator can be provided.

In a preferable embodiment, the high-frequency circuit further comprises an input/output line which is directly connected to a portion of an outermost strip subportion of the first or second spiral conductive strip.

Thus, a strong coupling between a compact resonator and an external circuit can be realized by using a simple and compact circuit.

For the sake of simplifying the circuit structure, it is preferable that the spiral conductive strip and the input/output line are formed in the same conductive circuit layer. However, similar effects can also be obtained by disposing the spiral conductive strip and the input/output line in different conductive circuit layers, and electrically connecting the spiral conductive strip and the input/output line via a through-via.

Preferably, the high-frequency circuit further comprises at least one stacked spiral conductive strip resonator formed on the multilayered dielectric substrate, the at least one stacked spiral conductive strip resonator having the same structure as that of a stacked spiral conductive strip resonator composed of the first and second spiral conductive strips, wherein the stacked spiral conductive strip resonators are disposed adjoining one another.

According to the above structure, the two adjoining stacked spiral conductive strip resonators each have a stacked structure, and therefore a spatial capacitance occurs between the stacked spiral conductive strips. In addition, when a current flows through one of the stacked spiral conductive strip resonators, a magnetic field which is generated so as to penetrate through the inside of the stacked spiral conductive strip resonator also closes its magnetic flux on the outside of the stacked spiral conductive strip resonator. Therefore, the magnetic field is in a direction perpendicular to the multilayered dielectric substrate. Consequently, by disposing the other stacked spiral conductive strip resonator so that this ambient magnetic field penetrates through the other stacked spiral conductive strip resonator with a sufficient intensity, a current can also flow through the other stacked spiral conductive strip resonator. Thus, by simply disposing the two stacked spiral conductive strip resonators so as to adjoin each other, a desired inter-resonator coupling can be obtained. Moreover, this advantageous effect of being able to adjust a coupling between the stacked spiral conductive strip resonators based on the distance therebetween can be obtained without requiring any additional processes which may involve the use of a material with high dielectric constant or the like. Therefore, the high-frequency circuit having the above structure can be produced at low cost.

In a preferable embodiment, at least one of the stacked spiral conductive strip resonators includes: a seventh spiral conductive strip formed in the first conductive circuit layer so as to adjoin the first spiral conductive strip, the seventh spiral conductive strip having the same rotating direction as the rotating direction of the first spiral conductive strip and having at least one turn; and an eighth spiral conductive strip formed in the second conductive circuit layer so as to adjoin the second spiral conductive strip, the eighth spiral conductive strip having the same rotating direction as the rotating direction of the second spiral conductive strip and having at least one turn; wherein the seventh and eighth spiral conductive strips overlap each another at respectively different levels.

Preferably, the high-frequency circuit further comprises a plurality of input/output lines coupled to the respective stacked spiral conductive strip resonators.

The above structure realizes a band-pass filter circuit by utilizing a plurality of stacked spiral conductive strip resonators, each resonator having a resonator length longer than that of each component spiral conductive strip. Since each stacked spiral conductive strip resonator occupies less space than does a conventional planar resonator, the resultant band-pass filter circuit also takes less space than does a band-pass filter circuit which is based on a conventional planar resonator structure. A conventional ½ wavelength resonator composed of a single layer of a planar circuit exhibits resonance also at a frequency which is twice the fundamental wave, a conventional band-pass filter composed of a ½ wavelength resonator would have unwanted passing characteristics in a frequency band which is twice as high as the fundamental frequency. However, in the high-frequency circuit having the above structure, each stacked spiral conductive strip resonator composing the filter circuit in itself has characteristics such that resonance at a frequency which is twice the fundamental wave is suppressed. As a result, there is provided an advantageous effect of inhibiting unwanted passing characteristics in a frequency band which is twice as high as the fundamental frequency. Moreover, the high-frequency circuit having the above structure can be produced at low cost because it can provide advantageous effects such as reduction in the circuit area, and inhibition of unwanted passing characteristics in a frequency band which is twice as high as the fundamental pass band, without requiring any additional processes which may involve the use of a material with high dielectric constant or the like. Therefore, the high-frequency circuit having the above structure can be produced at low cost.

Thus, according to the present invention, there is provided a compact resonator having a simple structure which does not resonate at a frequency about twice a fundamental resonance frequency, the resonator not requiring additional use of any special material, and a compact band-pass filter circuit having a blocking function for a frequency which is twice a transmission frequency.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
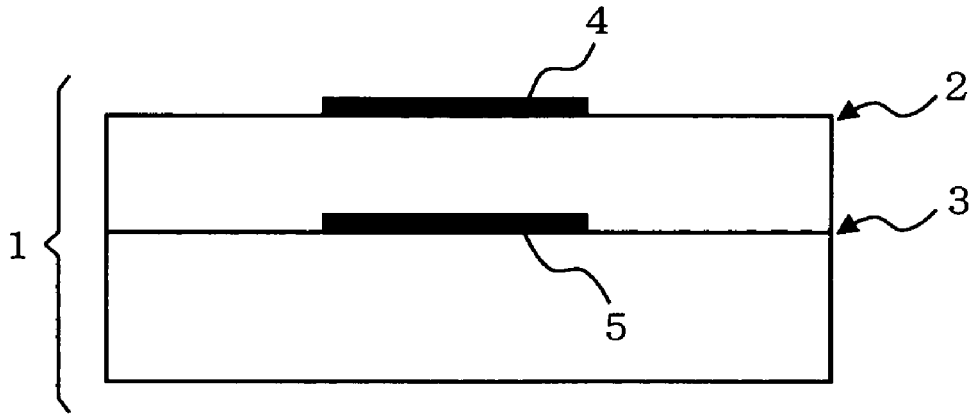
FIG. 1A is a schematic cross-sectional view showing a high-frequency circuit according to a first embodiment of the present invention taken along line AB in FIGS. 1B and 1C.

Hereinafter, embodiments of the high-frequency circuit according to the present invention will be described with reference to the figures. It will be appreciated that the present invention is not limited to the following embodiments. Although component elements having similar functions are denoted by the same reference numeral in different figures, this does not indicate that such component elements denoted by the same reference numeral are completely identical.

(First Embodiment)

Figure 1B:
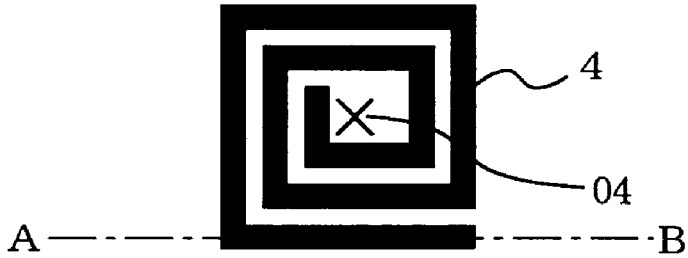
FIG. 1B is an upper plan view showing a pattern of a spiral conductive strip 4 which is formed on an outermost surface 2 of an upper conductive circuit layer in a multilayered dielectric substrate 1.
Figure 1C:
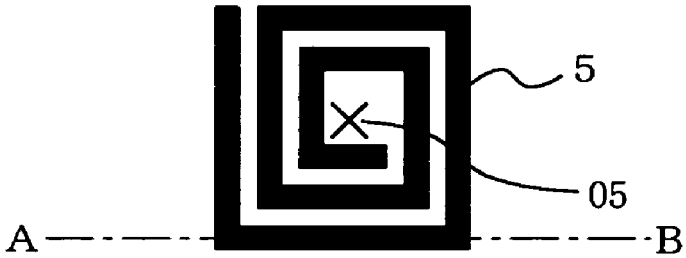
FIG. 1C is an upper plan view showing a pattern of a spiral conductive strip 5 formed on an interface 3 of a lower conductive circuit layer in the multilayered dielectric substrate 1.

FIG. 1A is a schematic cross-sectional view showing a high-frequency circuit according to a first embodiment of the present invention taken along line AB in FIGS. 1B and 1C. The high-frequency circuit according to the present embodiment is formed on a multilayered dielectric substrate 1 which has two conductive circuit layers. FIG. 1B is an upper plan view showing a pattern of a spiral conductive strip 4 which is formed on an outermost surface 2 of an upper conductive circuit layer in the multilayered dielectric substrate 1. FIG. 1C is an upper plan view showing a pattern of a spiral conductive strip 5 formed on an interface 3 of a lower conductive circuit layer in the multilayered dielectric substrate 1.

In the high-frequency circuit according to the first embodiment, the spiral conductive strip 4 is formed on the surface of an uppermost conductive circuit layer in the multilayered dielectric substrate 1 and the spiral conductive strip 5 is formed in the lower conductive circuit layer such that, if the outermost surface 2 were to be placed on the interface 3, a spiral center O4 of the spiral conductive strip 4 shown in FIG. 1B would coincide with a spiral center O5 of the spiral conductive strip 5 shown in FIG. 1C, and an outer periphery of the spiral conductive strip 4 would coincide with an outer periphery of the spiral conductive strip 5. The rotating direction of the spiral conductive strip 4 and the rotating direction of the spiral conductive strip 5 are opposite. The spiral conductive strip 4 has a clockwise rotating direction from the outside to the center of the spiral, as seen from above the circuit (in the following description, it is to be understood that any reference to a rotating direction of a spiral indicates a rotating direction from the outside to the center of the spiral, as seen from above the circuit). The spiral conductive strip 5, which is formed inside the multilayered dielectric substrate 1, has a counterclockwise rotating direction. The spiral conductive strips 4 and 5 each has 2.5 turns.

Hereinafter, an operation principle of the high-frequency circuit according to the first embodiment will be described.

Figure 2A:
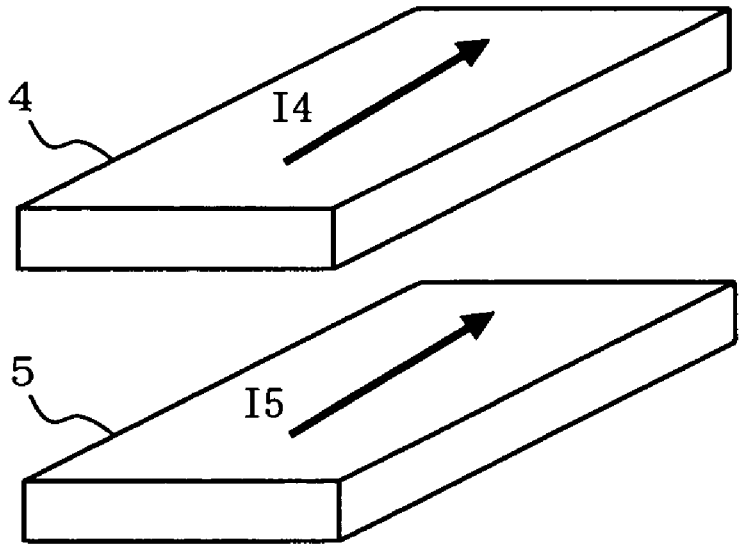
FIG. 2A is a diagram illustrating an even mode for explaining an operation principle of the high-frequency circuit according to the first embodiment.
Figure 2B:
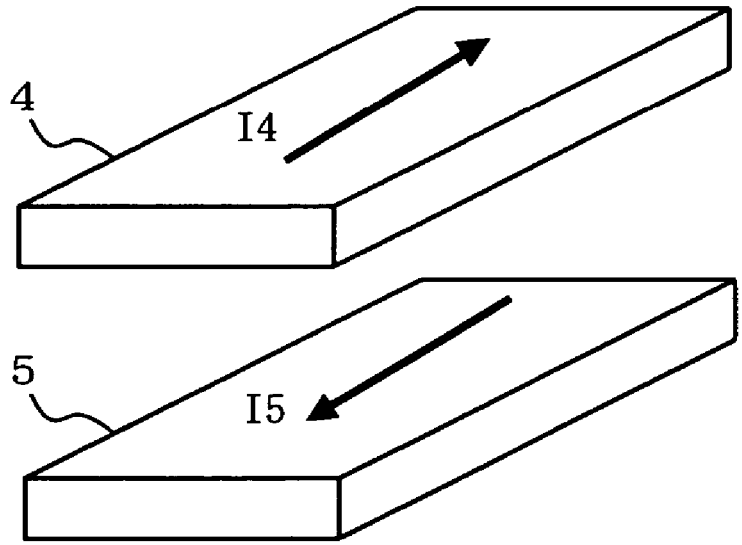
FIG. 2B is a diagram illustrating an odd mode for explaining an operation principle of the high-frequency circuit according to the first embodiment.

FIGS. 2A and 2B are diagrams for explaining an operation principle of the high-frequency circuit according to the first embodiment. When a high-frequency current I4 flows through the spiral conductive strip 4, a charge transfer occurs in a region of the spiral conductive strip 5 which overlaps with a portion of the spiral conductive strip 4, via an overlapping coupling capacitance. As used herein, such an "overlap" exists between different levels within the high-frequency circuit, i.e., at the level of the spiral conductive strip 4 and at the level of the spiral conductive strip 5. As a result, a high-frequency current I5 flows through the spiral conductive strip 5. Each such overlapping region can be regarded as containing two parallel coupled-lines of an arbitrary length. If the high-frequency current 14 flows through the spiral conductive strip 4, two modes will be induced: a mode as shown in FIG. 2A, in which the high-frequency current I4 flowing through the spiral conductive strip 4 and the high-frequency current I5 flowing through the spiral conductive strip 5 are in the same direction; and a mode as shown in FIG. 2B, in which the high-frequency current I4 flowing through the spiral conductive strip 4 and the high-frequency current I5 flowing through the spiral conductive strip 5 are in opposite directions. When regarding the overlapping region as parallel coupled-lines, the former mode is considered as an even mode, and the latter an odd mode.

Figure 3A:
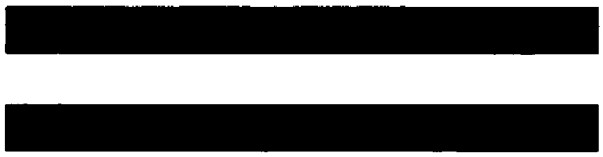
FIG. 3A is a diagram for explaining a structural dependency of coupling degree between parallel coupled-lines, illustrating an arrangement in which transmission lines are aligned so as to be completely parallel to each other.
Figure 3B:
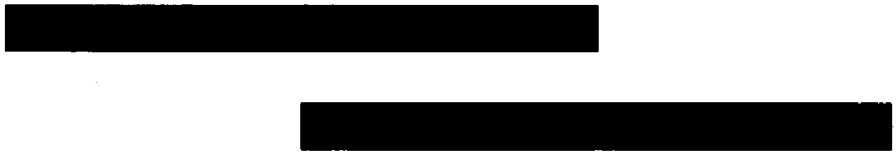
FIG. 3B is a diagram for explaining a structural dependency of coupling degree between parallel coupled-lines, illustrating an arrangement in which transmission lines are disposed parallel to each other, the transmission lines being shifted by half along the longitudinal dimension thereof.
Figure 3C:
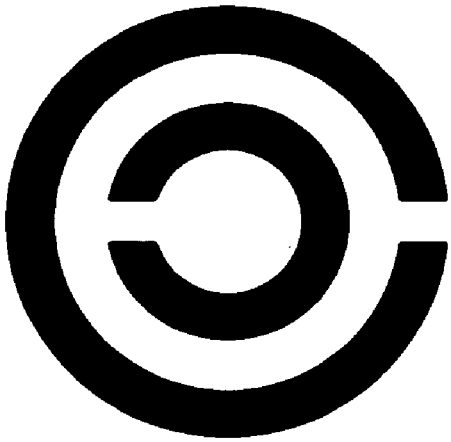
FIG. 3C is a diagram for explaining a structural dependency of coupling degree between parallel coupled-lines, illustrating an arrangement in which the structure of FIG. 3B is bent into a circular configuration so that an inner signal strip and an outer signal strip are coupled in two positions.

FIGS. 3A to 3C are diagrams for explaining structural dependencies of coupling degree between parallel coupled-lines. In FIGS. 3A to 3C, a ground conductor for each transmission line is omitted, and only the signal strips are shown. In an arrangement as shown in FIG. 3A, where the transmission lines are aligned so as to be completely parallel to each other, a high coupling degree cannot be obtained. The reason is that, if currents flow through both conductors in the same direction, and if both open terminating ends of each conductor satisfies the open condition, electrical charges of the same sign will be present at the open terminating ends of the two adjoining conductors, and will repel each other rather than coupling.

On the other hand, in an arrangement as shown in FIG. 3B, where the transmission lines are disposed parallel to each other so as to be shifted by half along the longitudinal dimension thereof, the coupling degree can be enhanced.

Furthermore, in an arrangement as shown in FIG. 3C, where the structure of FIG. 3B has been bent into a circular configuration so that an inner signal strip and an outer signal strip are coupled in two positions, the coupling degree between the two strips is maximized, and the resonance frequency is minimized. In this resonance mode, a current flows through both signal strips in the same direction, such that the current continues to flow from the outer signal strip to the inner signal strip, and further from the inner signal strip to the outer signal strip, via a capacitance between the strips. As a result, the high-frequency circuit shown in FIG. 3C can exhibit resonance with respect to electromagnetic waves which are far longer than the physical size that is occupied by the circuit structure. However, with the structure of FIG. 3C, how long wavelengths of electromagnetic waves the structure can function with depends solely on how much transfer of a high-frequency current can occur between the two lines. Therefore, the high-frequency circuit according to the present invention takes steps forward from the compact resonator structure shown in FIG. 3C, which escapes the constraints concerning the wavelength of electromagnetic waves, to realize a most compact resonator, by defining strip shapes for each line structure.

As has been explained with reference to FIG. 3C, according to the principle of the present invention, opposite rotating directions are prescribed for two spiral conductive strips which are formed one above the other in a high-frequency circuit, whereby an advantageous effect of achieving an increased resonator length and hence a more compact resonator can be efficiently realized.

Figure 4:
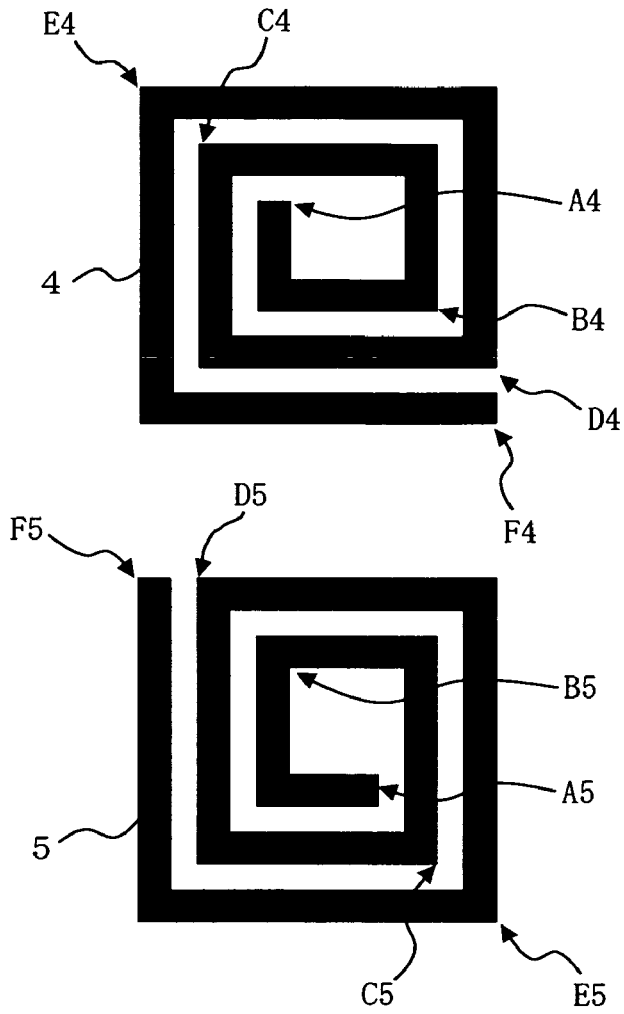
FIG. 4 is a diagram showing various points on spiral conductive strips 4 and 5 for explaining a current flow.

FIG. 4 is a diagram showing various points on spiral conductive strips 4 and 5 for explaining a current flow. Due to a distributive capacitance which exists at an overlapping portion between the two spiral conductive strips, a current component flowing through point B4 on the spiral conductive strip 4 is coupled to point C5 on the spiral conductive strip 5. As a result, a current flows from one point to another, in the order of F4→E4→D4→C4→B4→C5→D5→E5→F5. The resonator length Lcp-even in this case is much longer than a resonator length Lind of a single spiral conductive strip resonator which resonates due to a current flowing through the spiral conductive strip 4 in the order of F4→E4→D4→C4→B4→A4. Thus, the resonance frequency of a resonance which is obtained by providing such two spiral conductive strips 4 and 5 one above the other is lower than the lowest resonance frequency which can be realized by each of the spiral conductive strips 4 and 5 alone.

Figure 5:
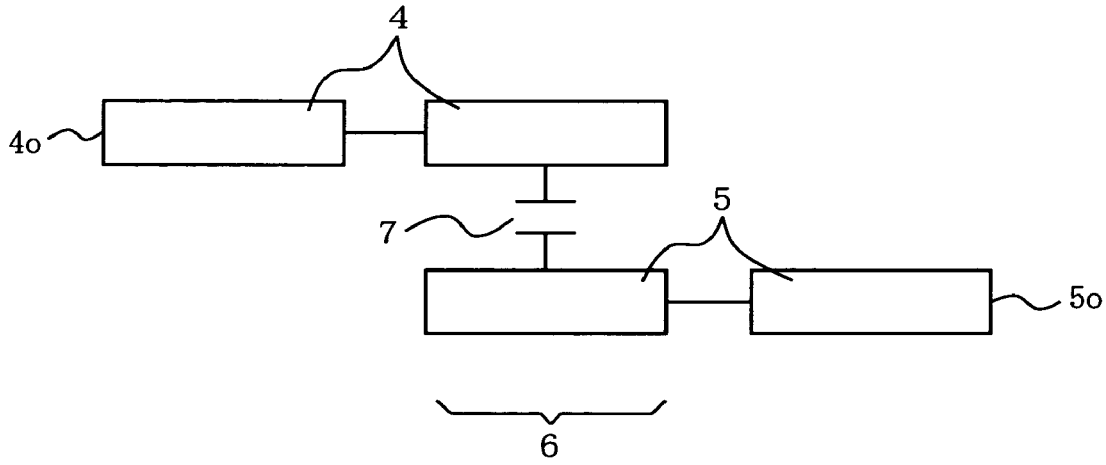
FIG. 5 is a diagram for explaining a principle by which resonance occurs at a fundamental frequency in a high-frequency circuit according to the present invention.

FIG. 5 is a diagram for explaining a principle by which resonance occurs at a fundamental frequency in the high-frequency circuit according to the present invention. Hereinafter, with reference to FIG. 5, the reason why resonance occurs at a fundamental frequency in the high-frequency circuit according to the present invention will be described. When open terminating ends 4*o* and 5*o* of outermost turns (hereinafter referred to as "outermost strip subportions") of the respective spiral conductive strips 4 and 5 are considered as open ends of the overall structure, a zero current distribution density exists at the open terminating ends 4*o* and 5*o*. Herein, the condition for obtaining a fundamental resonance at the lowest frequency is that a current distribution density of a current which is transferred between the spiral conductive strips is increased due to an overlapping coupling capacitance 7 at an overlapping portion 6 between the spiral conductive strips 4 and 5. In the high-frequency circuit according to the present invention, the spiral conductive strips 4 and 5 are coupled via the overlapping coupling capacitance 7 at the overlapping portion 6, so that the current distribution density is non-zero in the neighborhood of the overlapping portion 6 between the spiral conductive strips. Thus, it will be appreciated that the high-frequency circuit according to the present invention does not satisfy the conditions for being able to resonate at a frequency which is twice the fundamental resonance frequency: i.e., that the open terminating ends 4*o* and 5*o* of the outermost strip subportions of the two spiral conductive strips correspond to the open terminating ends of the resonance structure itself; and that a zero current distribution density exists in the neighborhood of the overlapping portion 6 between the spiral conductive strips. In other words, the high-frequency circuit according to the present invention has a resonance structure for suppressing resonance at a frequency which is twice the fundamental resonance frequency. Note that, in order to obtain this effect in the high-frequency circuit according to the present invention, any mechanical means such as through-vias should not be used to provide electrical conduction between the two spiral conductive strips.

Note that it is at a frequency which is three times the fundamental frequency that the resonating conditions are satisfied without a zero current density existing in the neighborhood of the overlapping portion between the two spiral conductive strips when a zero current distribution density exists at the open terminating ends of the outermost strip subportions of the spiral conductive strips.

Figure 6:
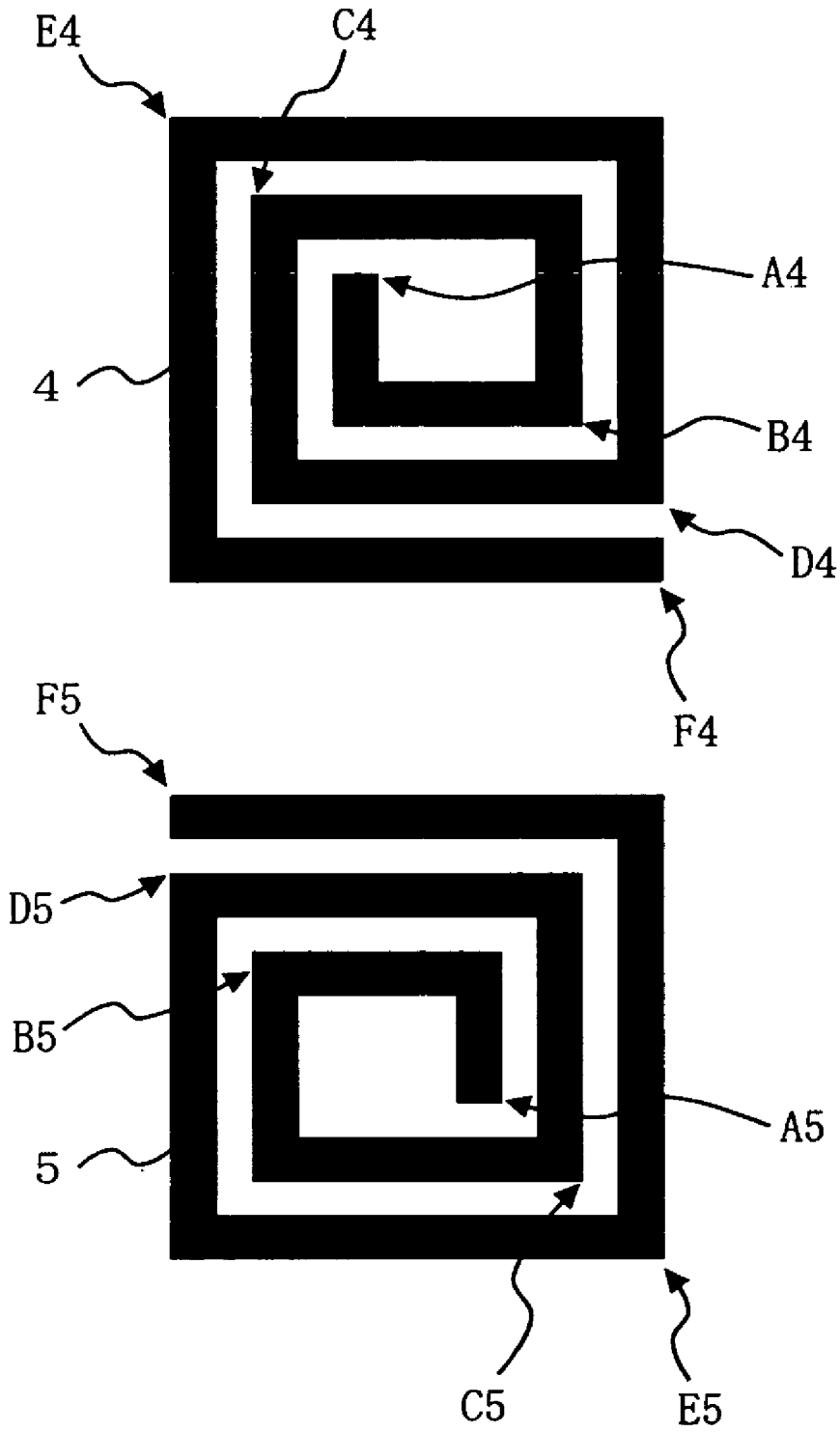
FIG. 6 is an upper plan view showing patterns of spiral conductive strips in the case where two layers of spiral conductive strips are formed in the same rotating direction.

A high-frequency circuit having a similar but different structure to the high-frequency circuit according to the present invention might be a high-frequency circuit which includes two layers of spiral conductive strip having the same rotating direction. FIG. 6 is an upper plan view showing patterns of spiral conductive strips in the case where two layers of spiral conductive strips are formed in the same rotating direction. However, in terms of the current flow in the two spiral conductive strips, the structure of FIG. 6 cannot attain an efficient downsizing of the circuit size. Let us assume that, under the conditions that a current flows clockwise through both the spiral conductive strip 5 and the spiral conductive strip 4, a current component flowing through point A5 on the spiral conductive strip 5 is coupled to point A4 on the spiral conductive strip 4 due to a distributive capacitance existing between the two spiral conductive strips. Since the spiral conductive strips 4 and 5 have the same rotating direction and therefore are mostly overlapped, a current will flow in the order of F4→E4→D4→C4→B4→C5→B5→A5. In this case, the resonator length Lcp-odd is not substantially different from a resonator length Lind of a single spiral conductive strip resonator which resonates due to a current flowing through the spiral conductive strip 4 in the order of A4→B4→C4→D4. Therefore, if the two spiral conductive strips have the same rotating direction, the effect of obtaining an increased resonator length (and hence a reduced resonance frequency) due to stacking of spiral conductive strips cannot be obtained. In other words, in order to the obtain the effect according to the present invention, the two overlapping spiral conductive strips which are placed one on top of the other must have opposite rotating directions.

Figure 7A:
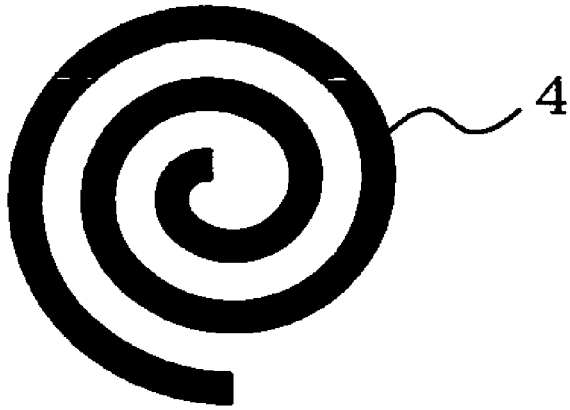
FIG. 7A is an upper plan view showing a pattern of a spiral conductive strip 4 whose outermost contour is circular.
Figure 7B:
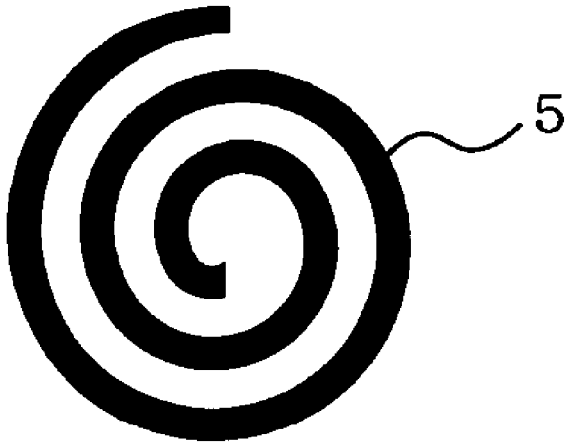
FIG. 7B is an upper plan view showing a pattern of a spiral conductive strip 5 whose outermost contour is circular.

In the high-frequency circuit according to the present invention, it is preferable that the two spiral conductive strips are patterned so that the outermost contour of the upper spiral conductive strip and the outermost contour of the lower spiral conductive strip, located at different levels, overlap each other. In the case of the square-shaped spiral conductive strips shown in FIG. 4, for example, it is preferable that the two spiral conductive strips are patterned so that the square outermost contours of the spiral conductive strips overlap with each other. This similarly applies to any other type of outermost contour, e.g., circles or polygons other than squares. FIGS. 7A and 7B are upper plan views showing patterns of spiral conductive strips 4 and 5 having a circular outermost contour. Note that transitions of a high-frequency current between the spiral conductive strips will occur more smoothly as the overlapping area between the spiral conductive strips increases. Therefore, for the sake of reducing the resonance frequency, it is preferable that the outermost contours of the stacked spiral conductive strips overlap each other in the broadest possible area.

Figure 8A:
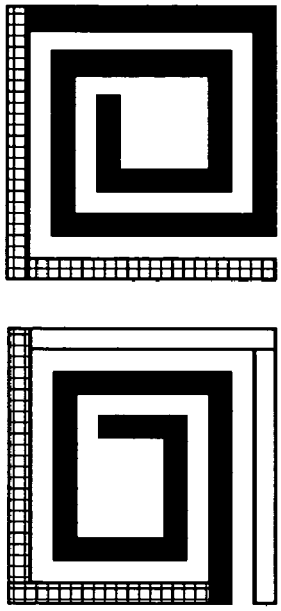
FIG. 8A is an upper plan view showing two spiral conductive strips whose open terminating ends are in the same direction as seen from the center of each spiral conductive strip.
Figure 8B:
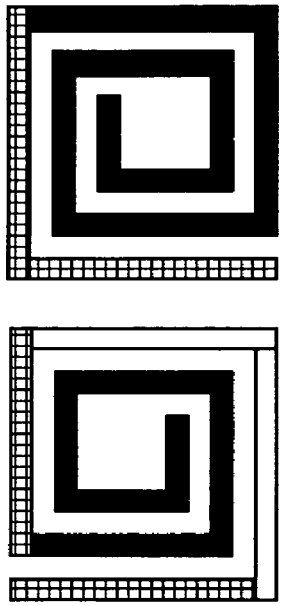
FIG. 8B is a view showing a variant from the arrangement of FIG. 8A where one of the spiral conductive strips has been rotated by 90° within its plane around the center of the spiral conductive strip.
Figure 8C:
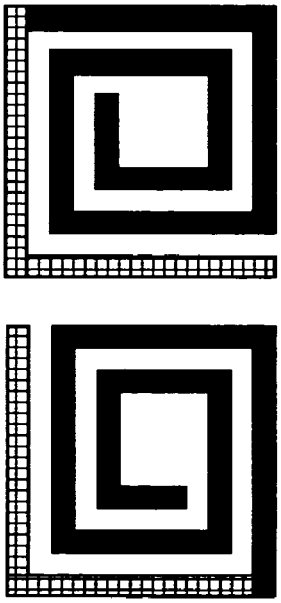
FIG. 8C is a view showing a variant from the arrangement of FIG. 8A where one of the spiral conductive strips has been rotated by 180° within its plane around the center of the spiral conductive strip.
Figure 8D:
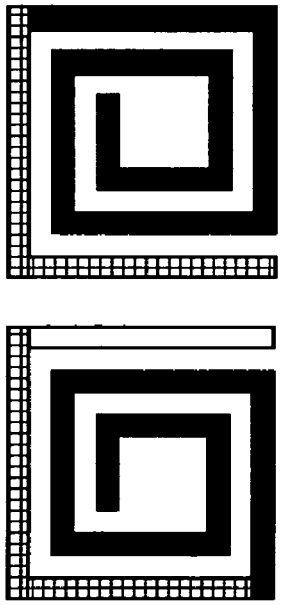
FIG. 8D is a view showing a variant from the arrangement of FIG. 8A where one of the spiral conductive strips has been rotated by 270° within its plane around the center of the spiral conductive strip.

In the high-frequency circuit according to the present invention, it is preferable that an open terminating end of the outermost strip subportion of the upper spiral conductive strip and an open terminating end of the outermost strip subportion of the lower spiral conductive strip are disposed diagonally opposite from each other, with respect to the spiral center of the upper spiral conductive strip. In the case of the square spiral conductive strips according to the first embodiment as shown in FIGS. 1B and 1C, for example, four types of arrangements as shown in FIGS. 8A to 8D may exist without losing integrity in the outermost contours of both spiral conductive strips, as follows. As shown in FIG. 8A, the open terminating ends of both spiral conductive strips are in the same direction from the center of each spiral conductive strip may be considered as the first arrangement. An arrangement shown in FIG. 8B is obtained by rotating one of the spiral conductive strips by 90° within its own plane around the center of the spiral conductive strip from the arrangement shown in FIG. 8A. An arrangement shown in FIG. 8C is obtained by rotating one of the spiral conductive strips by 180° within its own plane around the center of the spiral conductive strip from the arrangement shown in FIG. 8A. An arrangement shown in FIG. 8D is obtained by rotating one of the spiral conductive strips by 270° within its own plane around the center of the spiral conductive strip from the arrangement shown in FIG. 8A. In FIGS. 8A to 8D, any cross-hatched region indicates an overlap between the upper and lower spiral conductive strips, the overlap being taken only with respect to a region extending 0.5 turns from the open terminating end of the outermost strip subportion of the upper spiral conductive strip. In each cross-hatched region, an overlapping coupling capacitance is obtained between the two spiral conductive strips, so that a current transfer between the two spiral conductive strips can be obtained at a lower frequency, thus contributing the reduction of the resonance frequency. On the other hand, any blank (white) region in FIGS. 8A, 8B, and 8D indicates a portion of the outermost strip subportion of the lower spiral conductive strip which fails to overlap a region extending 0.5 turns from the open terminating end of the outermost strip subportion of the upper spiral conductive strip. In each blank (white) region, an effective overlapping coupling capacitance cannot be obtained; thus, the blank (white) region does not contribute to en effective reduction of the fundamental resonance frequency. Note, though, that the blank (white) region may still be able to couple to any portion that is not near the terminating end of the outermost strip subportion of the upper spiral conductive strip or any inner turn (subportion) of the strip. However, since the neighborhood of the open terminating end of the outermost strip subportion has the longest dimension, it will be clear that an arrangement having the smallest blank (white) region is capable of reducing the fundamental resonance frequency most. For this reason, the arrangement of FIG. 8C is the most preferable among the four possible arrangements for the high-frequency circuit according to the present embodiment of the invention, because the outermost strip subportions are overlapping with the highest probability near the open terminating ends of the spiral conductive strips. The second best is the arrangement of FIG. 8D. The third best is the arrangement of FIG. 8B. The least preferable of all is the arrangement of FIG. 8A. In the case where the outermost contour of each spiral conductive strip is circular (e.g., FIGS. 7A and 7B) or polygons other than squares, it is also preferable to satisfy the aforementioned condition.

Although FIG. 1A illustrates an embodiment in which the upper spiral conductive strip 4 is formed on the outermost surface of the multilayered dielectric substrate 1, the spiral conductive strip 4 may alternatively be formed at any interface within the multilayered dielectric substrate 1, or the conductive circuit layer in which the spiral conductive strip 4 is formed may be coated, and the advantageous effect of the present invention can still be obtained. In the case where the multilayered dielectric substrate 1 is composed of three or more layers, two or more of the conductive circuit layers may be formed between the spiral conductive strip 4 and the spiral conductive strip 5.

In the high-frequency circuit according to the present invention, the reason why each spiral conductive strip is illustrated as having one or more turns is so that a large overlapping region can be secured between the two stacked spiral conductive strips.

As described above, according to the first embodiment, there is provided a compact resonator having a simple structure which is much shorter than the wavelength of electromagnetic waves of a transmission band and which does not resonate at a frequency about twice a fundamental resonance frequency, the resonator not requiring additional use of any special material.

(Second Embodiment)

Figure 9A:
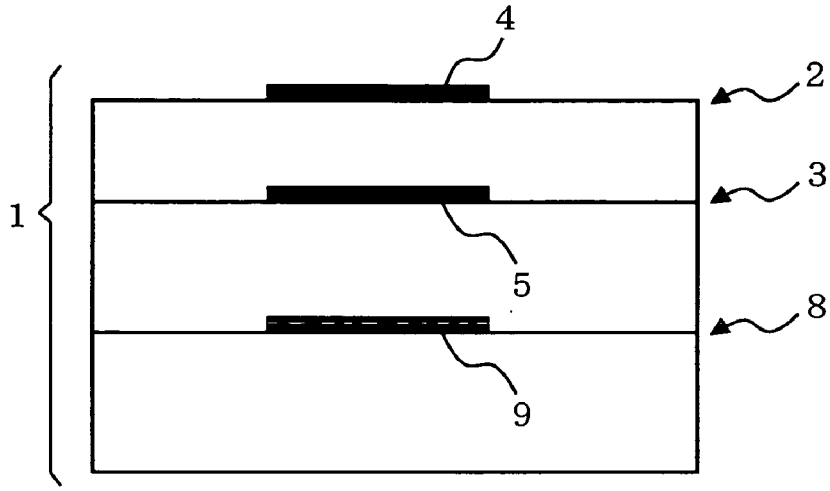
FIG. 9A is a schematic cross-sectional view showing a high-frequency circuit according to a second embodiment of the present invention taken along line CD in FIGS. 9B, 9C, and 9D.
Figure 9B:
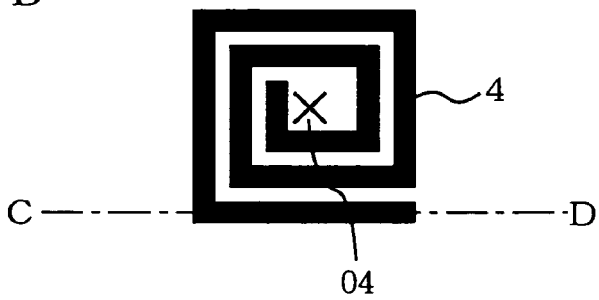
FIG. 9B is an upper plan view showing a pattern of a spiral conductive strip 4 which is formed on an outermost surface 2 of an uppermost conductive circuit layer in a multilayered dielectric substrate 1.
Figure 9C:
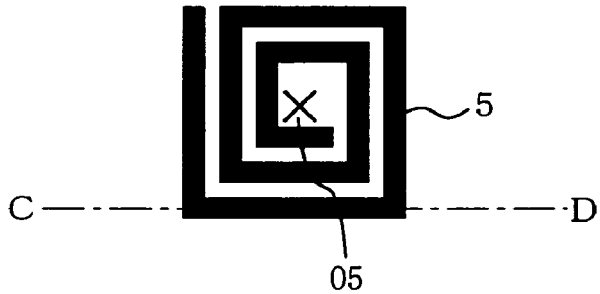
FIG. 9C is an upper plan view showing a pattern of a spiral conductive strip 5 formed on an interface 3 of an intermediate conductive circuit layer in the multilayered dielectric substrate 1.
Figure 9D:
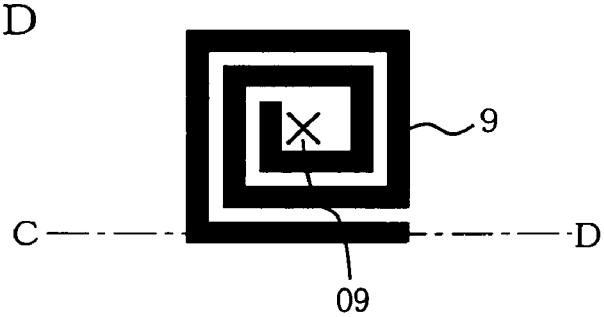
FIG. 9D is an upper plan view showing a pattern of a spiral conductive strip 9 formed on an interface 8 of a lowermost conductive circuit layer in the multilayered dielectric substrate 1.

FIG. 9A is a schematic cross-sectional view showing a high-frequency circuit according to a second embodiment of the present invention taken along line CD in FIGS. 9B, 9C, and 9D. The high-frequency circuit according to the present invention is formed on a multilayered dielectric substrate 1 which has three dielectric circuit layers. FIG. 9B is an upper plan view showing a pattern of a spiral conductive strip 4 which is formed on an outermost surface 2 of an uppermost conductive circuit layer in the multilayered dielectric substrate 1. FIG. 9C is an upper plan view showing a pattern of a spiral conductive strip 5 formed on an interface 3 of an intermediate conductive circuit layer in the multilayered dielectric substrate 1. FIG. 9D is an upper plan view showing a pattern of a spiral conductive strip 9 formed on an interface 8 of a lowermost conductive circuit layer in the multilayered dielectric substrate 1.

If the outermost surface 2, the interface 3, and the interface 8 were to be placed on one another, a spiral center O4 of the spiral conductive strip 4 shown in FIG. 9B, a spiral center O5 of the spiral conductive strip 5 shown in FIG. 9C, and a spiral center O9 of the spiral conductive strip 9 shown in FIG. 9D would coincide with one another, and an outer periphery of the spiral conductive strip 4 would coincide with an outer peripheries of the spiral conductive strips 4 and 5, 9 would coincide with one another.

The spiral conductive strip 4 has a clockwise rotating direction. The spiral conductive strip 5 has a counterclockwise rotating direction. The spiral conductive strip 5 has a clockwise rotating direction. Thus, beginning from the uppermost spiral conductive strip 4, the rotating directions of the three stacked spiral conductive strips are consecutively reversed from one another, such that any two adjoining spiral conductive strips have opposite rotating directions. Each spiral conductive strip has 2.5 turns.

Hereinafter, an operation principle of the high-frequency circuit according to the second embodiment will be described.

A high-frequency current flowing through the spiral conductive strip 4 is transferred to the spiral conductive strip 5, due to an overlapping coupling capacitance existing in an overlapping region between the spiral conductive strip 4 and the spiral conductive strip 5. If the overlapping region were regarded as constituting parallel coupled-lines, the portion of the spiral conductive strip 5 in which the high-frequency current flows in the same direction as that of the high-frequency current flowing through the spiral conductive strip 4 would correspond to a current distribution similar to that existing in an even mode of the parallel coupled-lines. In this portion, the effective dielectric constant increases, so that an increased coupled region length can be expected. Furthermore, a high-frequency current flowing through the spiral conductive strip 5 is transferred to the spiral conductive strip 9, due to an overlapping coupling capacitance existing in an overlapping region between the spiral conductive strip 5 and the spiral conductive strip 9. If the overlapping region were regarded as constituting parallel coupled-lines, the portion of the spiral conductive strip 9 in which the high-frequency current flows in the same direction as that of the high-frequency current flowing through the spiral conductive strip 5 would correspond to a current distribution similar to that existing in an even mode of the parallel coupled-lines. In this portion, a high coupling degree between the adjoining spiral conductive strips can be obtained. By these principles, even in the case where there are three or more overlapping spiral conductive strips, a mode in which a current flows through each spiral conductive strip in the same direction will exhibit resonance at the lowest frequency. When such a current distribution exists, the condition for an adjoining pair of overlapping spiral conductive strips 4 and 5 and an adjoining pair of overlapping spiral conductive strips 5 and 9 to each define a stacked spiral conductive strip resonator having the longest resonator length is identical to the condition for a stacked spiral conductive strip resonator composed of all three spiral conductive strips 4 and 5, 9 to have the longest resonator length. Therefore, prescribing each adjoining pair of overlapping spiral conductive strips in opposite directions is a sufficient condition for achieving the longest resonator length and exhibiting the lowest fundamental resonance frequency.

Note that, in the case where not every single adjoining pair of overlapping spiral conductive strips (in a structure composed of three or more overlapping spiral conductive strips) is composed of spiral conductive strips having opposite rotating directions, e.g., one of the adjoining pairs of overlapping spiral conductive strips is composed of a stacked structure of spiral conductive strips having the same rotating direction, for example, the other adjoining pairs will retain the same advantageous effect according to the present invention.

Although FIG. 9A illustrates an embodiment in which the spiral conductive strip 4 is formed on the outermost surface 2 of the multilayered dielectric substrate 1, the spiral conductive strip 4 may alternatively be formed at any interface within the multilayered dielectric substrate 1, or the conductive circuit layer in which the spiral conductive strip 4 is formed may be coated, and the advantageous effect of the present invention can still be obtained. In the case where the multilayered dielectric substrate 1 is composed of four or more layers of spiral conductive strips, similar effects can be obtained. Note that two or more dielectric circuit layers may be formed between spiral conductive strips.

As described above, according to the second embodiment, there is provided a compact resonator having a simple structure which is much shorter than the wavelength of electromagnetic waves of a transmission band and which does not resonate at a frequency about twice a fundamental resonance frequency, the resonator not requiring additional use of any special material.

(Third Embodiment)

Figure 10A:
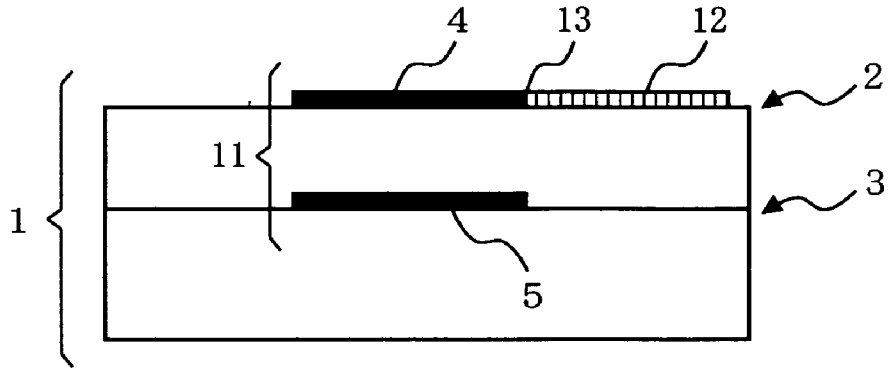
FIG. 10A is a schematic cross-sectional view showing a high-frequency circuit according to a third embodiment of the present invention taken along line EF in FIGS. 10B and 10C.
Figure 10B:
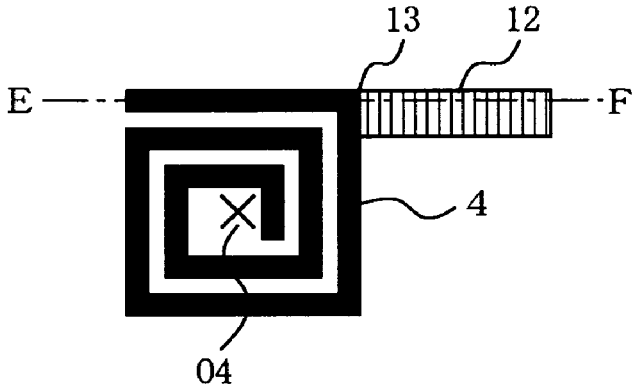
FIG. 10B is an upper plan view showing patterns of a spiral conductive strip 4 and an input/output line 12 which are formed on an outermost surface 2 of an upper conductive circuit layer in a multilayered dielectric substrate 1.
Figure 10C:
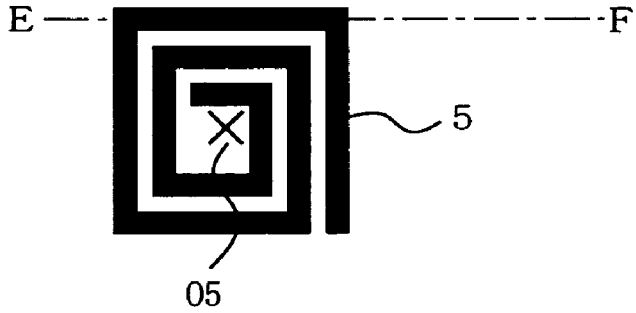
FIG. 10C is an upper plan view showing a pattern of a spiral conductive strip 5 formed on an interface 3 of a lower conductive circuit layer in the multilayered dielectric substrate 1.

FIG. 10A is a schematic cross-sectional view showing a high-frequency circuit according to a third embodiment of the present invention taken along line EF in FIGS. 10B and 10C. The high-frequency circuit according to the third embodiment is formed on a multilayered dielectric substrate 1 which has two dielectric circuit layers. FIG. 10B is an upper plan view showing patterns of a spiral conductive strip 4 and an input/output line 12 which are formed on an outermost surface 2 of an upper conductive circuit layer in the multilayered dielectric substrate 1. FIG. 10C is an upper plan view showing a pattern of a spiral conductive strip 5 formed on an interface 3 of a lower conductive circuit layer in the multilayered dielectric substrate 1.

As in the case of the first embodiment, point O4 shown in FIG. 10B and point O5 shown in FIG. 10C are in identical positions within each plane. The layered spiral conductive strips 4 and 5 together compose a stacked spiral conductive strip resonator 11. The input/output line 12 which is connected to the stacked spiral conductive strip resonator 11 is formed on an outermost surface 2 of the multilayered dielectric substrate 1. In other words, the spiral conductive strip 4 and the input/output line 12 are disposed in the same plane, and are directly connected to each other at a junction point 13.

In order to prevent decrease in the efficiency of energy transmission from an external circuit to the resonator, or from the resonator to an external circuit, or in order to construct a broad-banded filter circuit, a strong coupling between the resonator and the external circuit is essential. When coupling two transmission lines to each other, for example, the two transmission lines may simply be placed in parallel to each other, and their degree of coupling can be adjusted by varying the distance therebetween. As the distance between the transmission lines is decreased, the overlapping coupling capacitance between the transmission lines increases, and the coupling degree also increases. Moreover, if the coupled line length can be set to ¼ wavelength or ½ wavelength, the coupled transmission line structure will exhibit resonance, thus enabling an efficient energy transmission from one transmission line to the other. However, since a stacked spiral conductive strip resonator which is composed of a plurality of stacked spiral conductive strips will occupy a relatively small circuit area, it is difficult to obtain a strong coupling by merely placing an adjacent input/output line. While it might be possible to enhance the coupling degree by elongating the coupling distance by bending the input/output line so as to run along the outermost strip subportion of the spiral conductive strip through available interspaces, this would result in an unwanted increase in the occupied circuit area. Therefore, in the high-frequency circuit according to the third embodiment, the input/output line 12 is directly connected to a portion of the spiral conductive strip 4 composing the stacked spiral conductive strip resonator in order to obtain a stronger coupling between the two.

Generally speaking, direct connection to an input/output line in a ½ wavelength resonator can be problematic in that a strong coupling is obtained in too broad a band, since DC (direct current) connection exists between the two. This illustrates the need to obtain a high capacitance with a short coupled region length without there being a direct connection between the two, possibly resulting in techniques such as connection via a capacitor which uses a material with high dielectric constant, coupling via an extremely narrow distance between strips, or coupling by using a multilayered dielectric substrate having an extremely small interlayer distance. However, all of such techniques are hindrance to low cost. In the high-frequency circuit according to the third embodiment, a stacked spiral conductive strip resonator is composed of two or more spatially-separated spiral conductive strip structures, so that a current which is able to smoothly transfer between the spatially-separated spiral conductive strips can only have a limited frequency band. Therefore, DC coupling does not occur, and an excessively strong coupling is prevented from occurring in two broad a band. It is also possible to vary the coupling degree by changing the connection width at the site of direct connection.

FIG. 10A illustrates an example where the input/output line 12 and spiral conductive strip 4 which is directly connected thereto are formed in the same conductive layer. Alternatively, the spiral conductive strip to be directly connected to the input/output line 12 may be formed in a different conductive layer within the multilayered dielectric substrate 1. In such a structure, direct connection between the two may be realized by using a through-via which penetrates through at least a portion of the multilayered dielectric substrate 1.

Although FIG. 10A illustrates an embodiment in which the upper spiral conductive strip 4 is formed on the outermost surface 2 of the multilayered dielectric substrate 1, the spiral conductive strip 4 may alternatively be formed at any interface within the multilayered dielectric substrate 1, or the conductive circuit layer in which the spiral conductive strip 4 is formed may be coated, and the advantageous effect of the present invention can still be obtained.

Although FIG. 10A illustrates an example where the input/output line 12 is formed on the outermost surface 2 of the multilayered dielectric substrate 1, the input/output line 12 may alternatively be formed in an internal conductive layer within the multilayered dielectric substrate 1.

Although FIG. 10A illustrates an example where two spiral conductive strips are formed in two conductive circuit layers, three or more spiral conductive strips may be formed in three or more conductive circuit layers as described in the second embodiment.

As described above, according to the third embodiment, a strong coupling between a stacked spiral conductive strip resonator and an input/output line can be obtained by using a single and compact circuit.

(Fourth Embodiment)

Figure 11A:
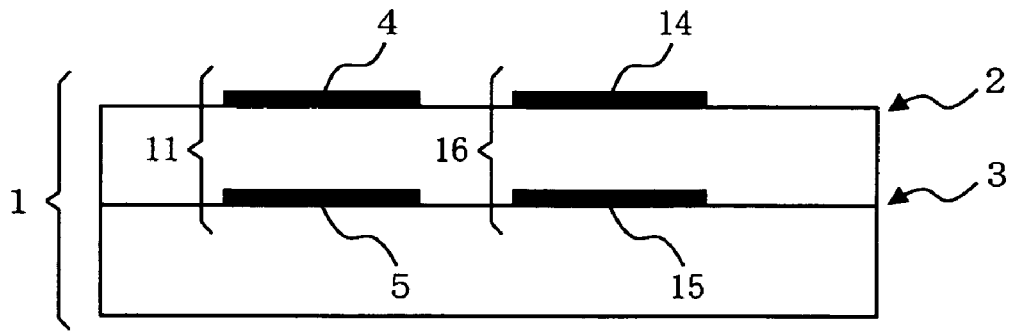
FIG. 11A is a schematic cross-sectional view showing a high-frequency circuit according to a fourth embodiment of the present invention taken along line GH in FIGS. 11B and 1C.
Figure 11B:
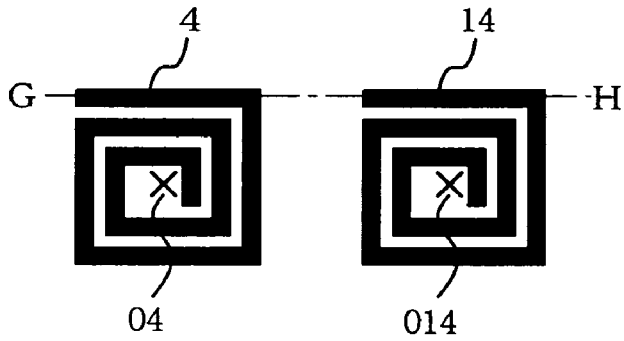
FIG. 11B is an upper plan view showing patterns of a spiral conductive strips 4 and 14 which are formed on an outermost surface 2 of an upper conductive circuit layer in a multilayered dielectric substrate 1.
Figure 11C:
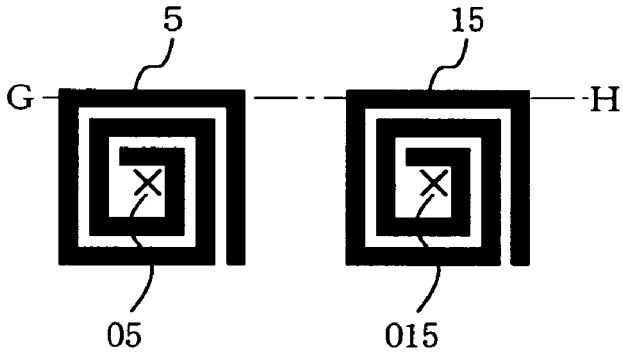
FIG. 11C is an upper plan view showing patterns of spiral conductive strips 5 and 15 which are formed on an interface 3 of a lower conductive circuit layer in the multilayered dielectric substrate 1.

FIG. 11A is a schematic cross-sectional view showing a high-frequency circuit according to a fourth embodiment of the present invention taken along line GH in FIGS. 11B and 11C. The high-frequency circuit according to the fourth embodiment is formed in a multilayered dielectric substrate 1 having two conductive circuit layers. FIG. 11B is an upper plan view showing patterns of a spiral conductive strips 4 and 14 which are formed on an outermost surface 2 of an upper conductive circuit layer in the multilayered dielectric substrate 1. FIG. 11C is an upper plan view showing patterns of spiral conductive strips 5 and 15 which are formed on an interface 3 of a lower conductive circuit layer in the multilayered dielectric substrate 1.

As in the case of the first embodiment, point O4 shown in FIG. 11B and point O5 shown in FIG. 11C are in identical positions within each plane. Point O14 shown in FIG. 11B and point O15 shown in FIG. 11C are in identical positions within each plane. The layered spiral conductive strips 4 and 5 together compose a stacked spiral conductive strip resonator 11. The layered spiral conductive strips 14 and 15 together compose a stacked spiral conductive strip resonator 16. In the stacked spiral conductive strip resonators 11 and 16, the upper spiral conductive strips 4 and 14 have a rotating direction which is opposite to that of the lower spiral conductive strips 5 and 15. The stacked spiral conductive strip resonator 11 and the stacked spiral conductive strip resonator 16 are disposed adjacent to each other.

Two techniques exist for coupling a plurality of resonators. One technique utilizes coupling via a capacitance between the resonators to be coupled. The other technique allows a magnetic field which is generated from one resonator to be coupled to the other resonator. In the high-frequency circuit according to the fourth embodiment, two stacked spiral conductive strip resonators are disposed adjacent each other (from a two-dimensional perspective) with a space therebetween, in order to obtain a coupling between the two stacked spiral conductive strip resonators, each of which is composed by layering spiral conductive strips having opposite rotating directions. Since each stacked spiral conductive strip resonator is a compact resonator capable of realizing a fundamental resonance frequency far lower than the resonance frequency that can be attained by each of the component spiral conductive strips, it would be difficult to obtain an adequate coupling with an external circuit based on a spatial capacitance occurring between the stacked spiral conductive strip resonator and an adjacent transmission line. The reason is that, because a stacked spiral conductive strip resonator occupies a relatively small area despite its long resonator length, only a short distance is available between each spiral conductive strip and an adjacent transmission line, relative to the wavelength of the fundamental resonance frequency. However, each of the two adjacent stacked spiral conductive strip resonators in the high-frequency circuit according to the fourth embodiment has a stacked structure, and therefore multiple spatial capacitances occur between the stacked strips. Furthermore, by adjusting the relative positions of the stacked spiral conductive strip resonators so that a magnetic field penetrating through one of the stacked spiral conductive strip resonators (which is generated when a current flows along the stacked spiral conductive strip resonator) will penetrate through the center of the other stacked spiral conductive strip resonator on the outside of the one stacked spiral conductive strip resonator, it becomes possible to induce a current to flow through the other stacked spiral conductive strip resonator. Thus, by simply disposing the two adjacent stacked spiral conductive strip resonators, a desired coupling between the resonators can be obtained.

The advantageous effect of achieving coupling between stacked spiral conductive strip resonators can be obtained without requiring any additional process that may involve the use of a material with high dielectric constant, for example. Therefore, the high-frequency circuit according to the fourth embodiment has an advantage in that it can be produced at low cost.

FIG. 11A illustrates an example where the spiral conductive strips 4 and 14 are formed in the conductive layer, and the spiral conductive strips 5 and 15 are formed in the conductive layer. However, the advantageous effect of the present invention can be similarly obtained in the case where the spiral conductive strips 4 and 14 are formed in different conductive layers and the spiral conductive strips 5 and 15 are formed in different conductive layers.

Although FIG. 11A illustrates an embodiment in which the upper spiral conductive strips 4 and 14 of the stacked spiral conductive strip resonators 11 and 16 are formed on the outermost surface 2 of the multilayered dielectric substrate 1, the spiral conductive strips 4 and 14 may alternatively be formed at any interface within the multilayered dielectric substrate 1, or the conductive circuit layer in which the spiral conductive strips 4 and 14 are formed may be coated, and the advantageous effect of the present invention can still be obtained.

Although the above illustrates an example where two stacked spiral conductive strip resonators are coupled, three or more stacked spiral conductive strip resonators may instead be coupled.

As described above, according to the fourth embodiment, it is possible to obtain coupling between stacked spiral conductive strip resonators each of which is a more compact resonator than conventional resonators, based on a simple structure and without using any special material.

(Fifth Embodiment)

Figure 12A:
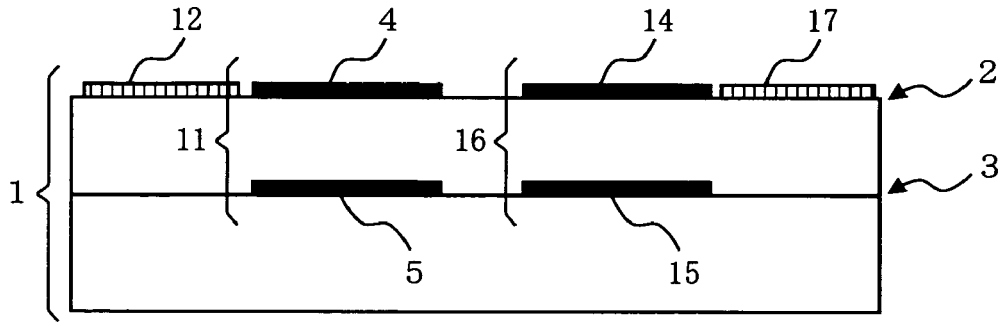
FIG. 12A is a schematic cross-sectional view showing a high-frequency circuit according to a fifth embodiment of the present invention taken along line IJ in FIGS. 12B and 12C.
Figure 12B:
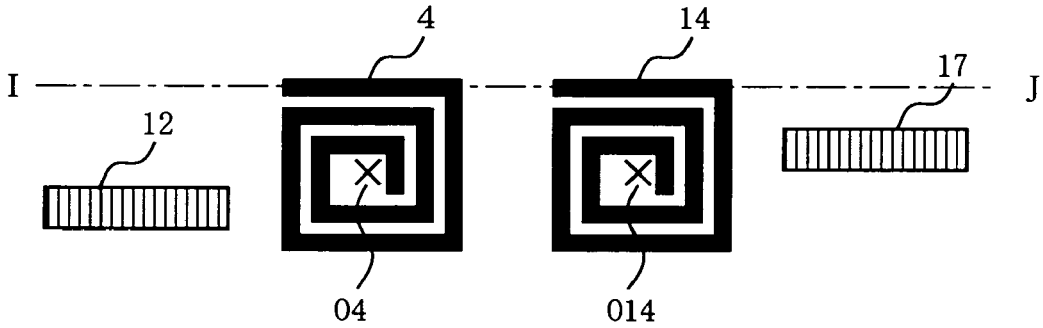
FIG. 12B is an upper plan view showing patterns of spiral conductive strips 4 and 14 and input/output lines 12 and 17 which are formed on an outermost surface 2 of an upper conductive circuit layer in a multilayered dielectric substrate 1.
Figure 12C:
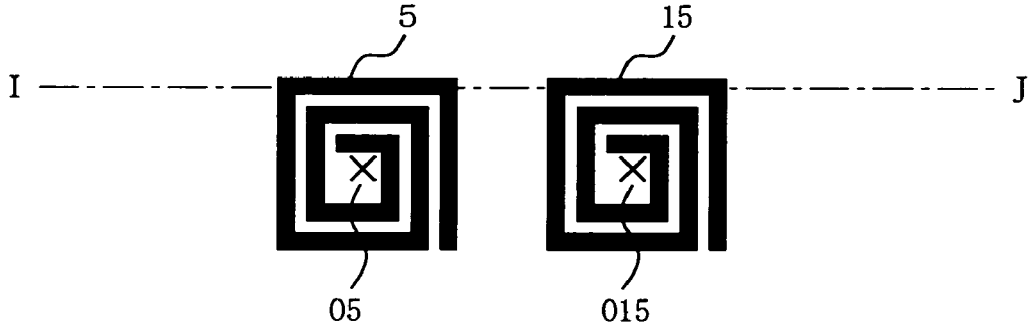
FIG. 12C is an upper plan view showing patterns of spiral conductive strips 5 and 15 which are formed on an interface 3 of a lower conductive circuit layer in the multilayered dielectric substrate 1.

FIG. 12A is a schematic cross-sectional view showing a high-frequency circuit according to a fifth embodiment of the present invention taken along line IJ in FIGS. 12B and 12C. Although the input/output lines 12 and 17 are not exactly contained in the cross section along line IJ, FIG. 12A conveniently illustrates the input/output lines 12 and 17 as projection images.

FIG. 12B is an upper plan view showing patterns of spiral conductive strips 4 and 14 and input/output lines 12 and 17 which are formed on an outermost surface 2 of an upper conductive circuit layer in a multilayered dielectric substrate 1. FIG. 12C is an upper plan view showing patterns of spiral conductive strips 5 and 15 which are formed on an interface 3 of a lower conductive circuit layer in the multilayered dielectric substrate 1.

As in the case of the first embodiment, point O4 shown in FIG. 12B and point O5 shown in FIG. 12C are in identical positions within each plane. Point O14 shown in FIG. 12B and point O15 shown in FIG. 12C are in identical positions within each plane. The layered spiral conductive strips 4 and 5 together compose a stacked spiral conductive strip resonator 11. The layered spiral conductive strips 14 and 15 together compose a stacked spiral conductive strip resonator 16. The spiral conductive strips 4 and 5 have opposite rotating directions. The spiral conductive strips 14 and 15 have opposite rotating directions. The spiral conductive strips 4 and 14 formed on the upper surfaces of the respective stacked spiral conductive strip resonators have the same rotating direction. The stacked spiral conductive strip resonator 11 and the stacked spiral conductive strip resonator 16 are disposed adjacent to each other and coupled. Adjacent to the spiral conductive strip 4 is provided an input/output line 12 for realizing coupling between an external circuit and the stacked spiral conductive strip resonator 11. Adjacent to the spiral conductive strip 14 is provided an input/output line 17 for realizing coupling between an external circuit and the stacked spiral conductive strip resonator 16.

The high-frequency circuit according to the fifth embodiment realizes a band-pass filter composed of stacked spiral conductive strip resonators. Since each stacked spiral conductive strip resonator is a compact resonator capable of realizing a fundamental resonance frequency lower than the fundamental resonance frequency that can be attained by each of the component spiral conductive strips, the high-frequency circuit according to the fifth embodiment can also be reduced in size. Note that a conventional ½ wavelength resonator which is composed of a single layer of a planar circuit will exhibit resonance at a frequency which is twice the fundamental wave as well, so that a conventional band-pass filter composed of a ½ wavelength resonator would show passing characteristics in a frequency range which is twice as high as the fundamental frequency. On the other hand, a stacked spiral conductive strip resonator, although being a ½ wavelength resonator, does not exhibit resonance at a frequency which is twice the fundamental wave. Therefore, the high-frequency circuit according to the fifth embodiment provides an advantageous effect in that it does not show passing characteristics in a frequency range which is twice as high as the fundamental frequency.

FIG. 12A illustrates an example where spatial capacitances are utilized in order to obtain coupling between the stacked spiral conductive strip resonator 11 and the input/output line 12, and between the stacked spiral conductive strip resonator 16 and the input/output line 17. Alternatively, it is possible to interconnect the spiral conductive strip 4 and the input/output line 12 via a capacitor, and interconnect the spiral conductive strip 14 and the input/output line 17 via a capacitor. In this case, the optimum coupling degree for obtaining desired characteristics can be achieved by adjusting the capacitance values of the capacitors. Furthermore, it would also be possible to obtain coupling by directly connecting the spiral conductive strip 4 to the input/output line 12 and directly connecting the spiral conductive strip 14 to the input/output line 17, in which case the optimum coupling degree for obtaining desired characteristics can be adjusted by varying the connection width.

FIG. 12A illustrates an example where the spiral conductive strips 4 and 14 to be coupled to the input/output lines 12 and 17 are formed in the same conductive layer. However, the advantageous effect of the present invention can be similarly obtained in the case where the spiral conductive strips 4 and 14 are formed in different conductive layers.

Although FIG. 12A illustrates an embodiment in which the upper spiral conductive strips 4 and 14 of the stacked spiral conductive strip resonators 11 and 16 are formed on the outermost surface 2 of the multilayered dielectric substrate 1, the spiral conductive strips 4 and 14 may alternatively be formed at any interface within the multilayered dielectric substrate 1, or the conductive circuit layer in which the spiral conductive strips 4 and 14 are formed may be coated, and the advantageous effect of the present invention can still be obtained.

Although FIG. 12A illustrates an example where the input/output lines 12 and 17 are formed on the outermost surface 2 of the multilayered dielectric substrate 1, the input/output lines 12 and 17 may alternatively be formed in an internal conductive layer within the multilayered dielectric substrate 1.

Although the above illustrates an example where stacked spiral conductive strip resonator are coupled, three or more stacked spiral conductive strip resonator may instead be coupled.

As described above, according to the fifth embodiment, a high-frequency circuit which is more compact than a conventional high-frequency circuit can be provided based on a simple structure and without using any special material, the high-frequency circuit having band-pass filter characteristics free without showing passing characteristics in a frequency range which is twice as high as its pass band.

(Example of the First Embodiment)

Figure 13A:
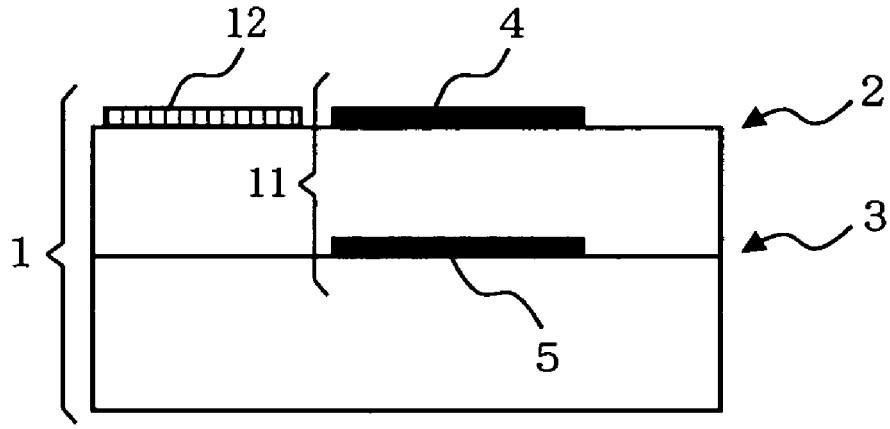
FIG. 13A is a schematic cross-sectional view showing a high-frequency circuit for evaluation which was subjected to a measurement.
Figure 13B:
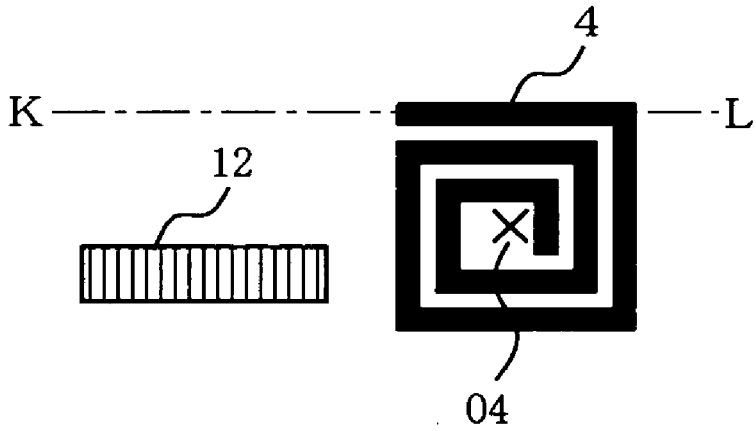
FIG. 13B is an upper plan view showing patterns of a spiral conductive strip 4 and an input/output line 12 of a high-frequency circuit for evaluation which was subjected to a measurement.
Figure 13C:
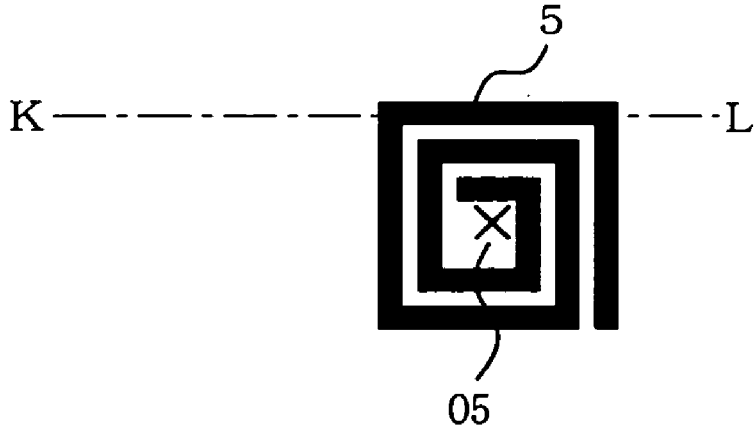
FIG. 13C is an upper plan view showing patterns of a spiral conductive strip 5 of a high-frequency circuit for evaluation which was subjected to a measurement.

The inventors produced an example of the high-frequency circuit according to the first embodiment, and measured the resonance characteristics thereof. FIGS. 13A to 13C are cross-sectional views showing a schematic structure of a high-frequency circuit for evaluation which was subjected to the measurement. FIG. 13A is a schematic cross-sectional view showing the high-frequency circuit for evaluation along line KL in FIGS. 13B and 13C. FIG. 13A illustrates an input/output line 12 as a projection image. FIG. 13B is an upper plan view showing patterns of a spiral conductive strip 4 and the input/output line 12, which are formed on an outermost surface 2 of an upper conductive circuit layer in a multilayered dielectric substrate 1. FIG. 13C is an upper plan view showing a pattern of a spiral conductive strip 5, which is formed on an interface 3 of a lower conductive circuit layer in the multilayered dielectric substrate 1.

With respect to the high-frequency circuit for evaluation, the inventors measured a reflection from a single terminal, with the input/output line 12 having a microstrip structure functioning as an adjacent probe, while maintaining a low coupling degree with the stacked spiral conductive strip resonator 11. The inventors estimated a Q value from a resonance frequency and a reflection band. The inventors evaluated the fundamental resonance and second-order resonance.

Table 1 shows parameters and characteristics of the Example of the high-frequency circuit according to the present invention and Comparative Examples. In both the Example and the Comparative Examples, the evaluated substrate was a RT/Duroid substrate having a dielectric constant of 10.2 and a dielectric loss tangent of 0.003. Each multilayered substrate structure was constructed on a piece of this substrate material having a thickness of 640 microns (base substrate). After applying a copper strip having a thickness of 40 microns to both sides thereof, another piece of the same substrate material having a thickness of 130 microns was attached to the base substrate as an additional layer. Each copper strip to be formed on the upper face of the additional layer had a thickness of 40 microns. All strips had a strip width of 200 microns. The inter space between any adjoining strips within the same plane was 200 microns. Each spiral conductive strip formed had a square outer shape of 2500 microns by 2500 microns. A copper piece which was attached across the entire back face of each multilayered dielectric substrate was allowed to function as a high-frequency ground. Regardless of whether there was any additional layer introduced to the multilayered substrate structure or not, the measurement terminal was always formed on the uppermost surface.

TABLE 1

| | spiral (rotating direction) | | fundamental resonance | | second-order resonance | | |
|---|---|---|---|---|---|---|---|
| | | | frequency | Q value | frequency | Q value | notes |
| Example 1 | upper face | clockwise | 1.42 GHz | 75.4 | 4.45 GHz | 76.5 | w/ additional layer |
| | lower face | counter-clockwise | | | | | |
| Comparative Example 1 | upper face | clockwise | 2.62 GHz | 65.8 | 3.39 GHz | 63.3 | |
| | lower face | clockwise | | | | | |
| Comparative Example 2 | upper face | clockwise | 3.31 GHz | 96.6 | 8.01 GHz | 94.9 | |
| | lower face | none | | | | | |
| Comparative Example 3 | upper face | none | 3.35 GHz | 103.5 | 8.00 GHz | 98.9 | w/o additional layer |
| | lower face | clockwise | | | | | |
| Comparative Example 4 | upper face | none | 2.54 GHz | 89.4 | 5.84 GHz | 83.5 | w/ additional layer |
| | lower face | clockwise | | | | | |

Example 1 and Comparative Example 1 both had a structure including two layers of spiral conductive strips each having 2.5 turns. In Example 1, the upper and lower spiral conductive strips had opposite rotating directions. In Comparative Example 1, the upper and lower spiral conductive strips had the same rotating direction. While Example 1 showed resonance at 1.42 GHz, Comparative Example 1 showed resonance at 2.62 GHz.

In Comparative Example 2, a single spiral conductive strip having a clockwise rotating direction was formed only on the surface of the additional layer. Comparative Example 2 showed a resonance frequency of 3.31 GHz and a Q value of 96.6.

In Comparative Example 3, no additional layer was provided, and a single spiral conductive strip having a clockwise rotating direction was formed on the surface of the base substrate having a thickness of 640 microns. Comparative Example 3 showed a resonance frequency of 3.35 GHz and a Q value of 103.5.

In Comparative Example 4, a single spiral conductive strip having a clockwise rotating direction was formed on the surface of the base substrate having a thickness of 640 microns, and thereafter the base substrate was coated with an additional layer. No spiral conductive strip was formed on the additional layer. Comparative Example 4 showed a resonance frequency of 2.66 GHz and a Q value of 91.6.

From these results, it is clear that the resonance frequency of Example 1 is reduced by 46% relative to the resonance frequency of Comparative Example 1. From the resonance frequency of Example 1, it can be seen that the effective resonator length is increased almost twofold, as compared to any of Comparative Examples 2 to 4 which were constructed according to various multilayered substrate conditions. Thus, it has been confirmed that Example 1 is a more compact resonator than Comparative Examples 2 to 4.

In Example 1, the second-order resonance frequency was about three times as high as the fundamental frequency, and no resonance occurred at a frequency which is twice the fundamental resonance frequency.

Figure 14:
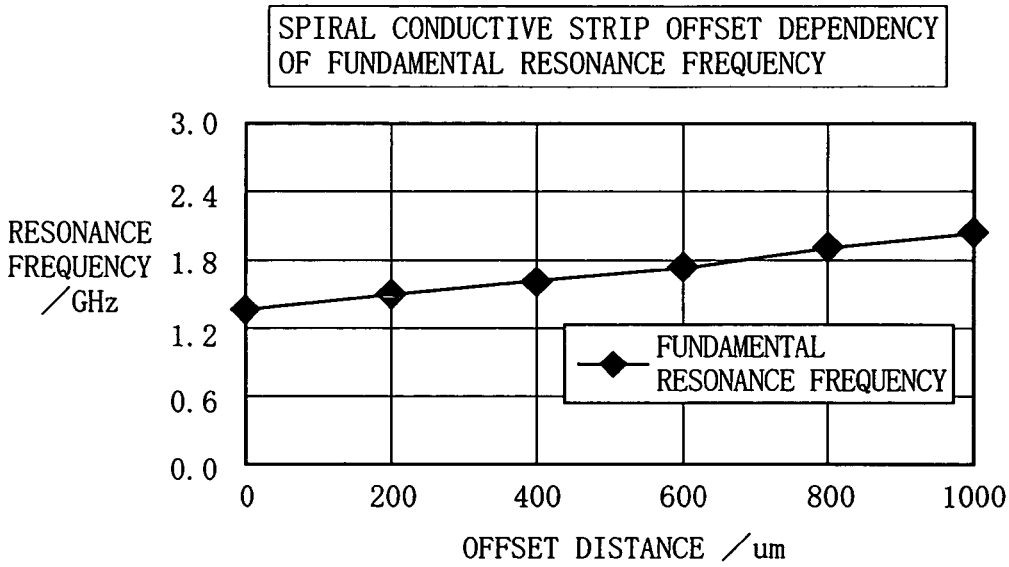
FIG. 14 is a graph showing changes in a fundamental resonance frequency with respect to a relative offset distance between upper and lower spiral conductive strips.

Next, six more high-frequency circuits having spiral conductive strip structures similar to that of Example 1 were produced, in order to ascertain the influence of relative offsets between the upper and lower spiral conductive strips on the fundamental resonance frequency. FIG. 14 is a graph showing changes in the fundamental resonance frequency with respect to a relative offset distance between the upper and lower spiral conductive strips. As is clear from FIG. 14, the lowest fundamental resonance frequency was obtained when the outer peripheries of the layered spiral conductive strips coincided. This indicates that, since the mutual transfers of high-frequency currents between the spiral conductive strips can occur more smoothly as there is a larger overlapping portion between the spiral conductive strips which are situated at two different levels, it is preferable from the standpoint of resonance frequency reduction to ensure that the outer peripheries of the layered spiral conductive strips overlap each other in the broadest possible area.

Figure 15:
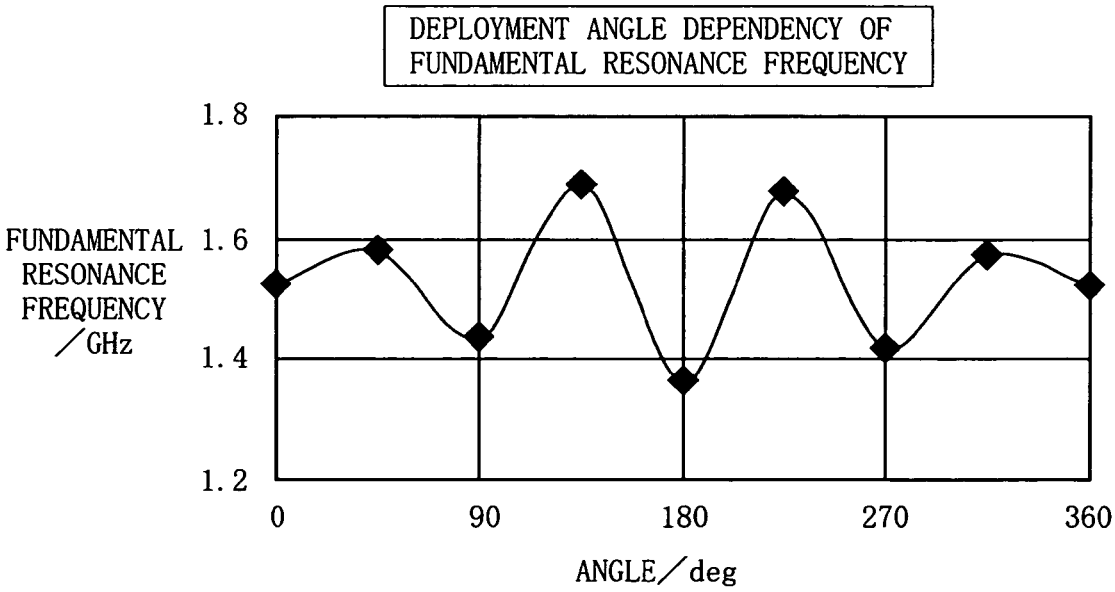
FIG. 15 is a graph showing measurement results of properties of several high-frequency circuits in which the orientation of a spiral conductive strip formed on the surface of an additional layer is rotated by 45° each.

Next, in order to ascertain the influence of different manners of overlapping between the spiral conductive strips, the inventors measured the characteristics of several high-frequency circuits which were obtained by rotating the orientation of the spiral conductive strip formed on the additional layer by 45° each, while fixing the spiral conductive strip formed on the base substrate surface in terms of both shape and orientation. The measurement results are shown in FIG. 15. Similar measurements were taken for the case where each spiral conductive strip had 2.25 turns, the results being shown in FIG. 16. Also, similar measurements were taken for the case where each spiral conductive strip had 2 turns, the results being shown in FIG. 17.

Figure 16:
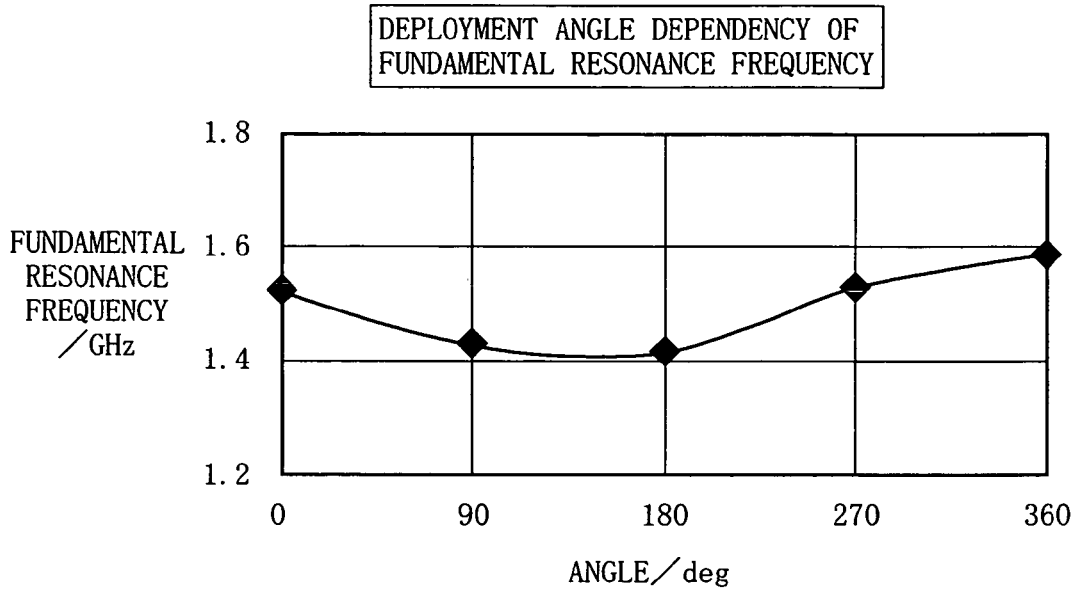
FIG. 16 is a graph showing measurement results in the case where each spiral conductive strip has 2.25 turns.
Figure 17:
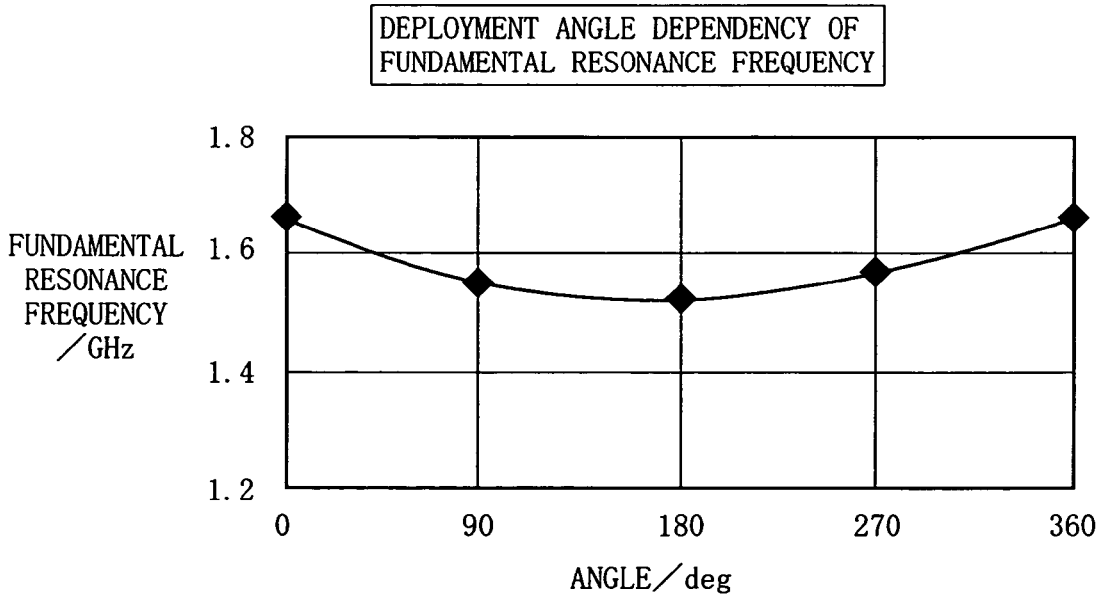
FIG. 17 is a graph showing measurement results in the case where each spiral conductive strip has 2 turns.

In FIGS. 15 to 17, a state where the open terminating ends of both spiral conductive strips are in the same direction from the center of each spiral conductive strip is defined as having an angle (hereinafter "deployment angle") of 0°. Regardless of the number of spiral conductive strips, high-frequency circuits in the case where the above-defined deployment angle was 180° showed the lowest fundamental resonance frequency.

In other words, it was confirmed that a most compact resonator can be provided in the case where the open terminating ends of both spiral conductive strips are disposed diagonally opposite from each other with respect to the spiral center of each spiral conductive strip. It was also found that, with any deployment angle value, the high-frequency circuit functions as a resonator having a resonator length which is at least 34% longer than the resonator length of each component spiral conductive strip.

(Examples of the Second Embodiment)

Next, the inventors produced examples (Examples 2 to 4) of the high-frequency circuit according to the second embodiment each of which had, in addition to the structure of Example 1, an additional layer of an RT/Duroid substrate having a thickness of 130 microns further attached on the surface, thus obtaining a circuit substrate based on triple-layered dielectric substrate. In the three conductive circuit layers (including the outermost surface), an equivalent spiral conductive strip composed of a copper strip having a thickness of 40 microns was formed, thus constructing a stacked spiral conductive strip resonator structure. The configuration of the spiral conductive strips was similar to that of Example 1. As in Example 1, a fundamental resonance frequency and a Q value, as well as a second-order resonance frequency and a Q value, of the resonator were assessed by utilizing a probe structure formed on the outermost surface. A copper piece which was attached across the entire back face of each multilayered dielectric substrate was allowed to function as a high-frequency ground.

Table 2 shows parameters and characteristics of Examples 2 to 4 and Comparative Example 5. In Example 2, all of the three layers of spiral conductive strips had consecutively opposite rotating directions. In Example 3, the first and second layers had opposite rotating directions, whereas the second and third layers had the same rotating direction. In Example 4, the first and second layers had the same rotating directions, whereas the second and third layers had opposite rotating directions. In Comparative Example 5, all of the three layers of spiral conductive strips had the same rotating direction.

As is clear from Table 2, Example 2, in which each adjoining pair of overlapping spiral conductive strips had opposite rotating directions, showed the lowest fundamental resonance frequency. On the other hand, Comparative Example 5, in which all of the three layers of spiral conductive strips had the same rotating direction, only showed a fundamental resonance frequency which was substantially the same as the fundamental resonance frequency which would be exhibited by each component spiral conductive strip as a ½ wavelength resonator. Examples 3 and 4, in which only one of the two adjoining pairs of overlapping spiral conductive strips had opposite rotating directions, had a lower fundamental resonance frequency than that of Comparative Example 5, although not quite as low as that of Example 2. Comparative Example 5 showed resonance at a frequency which was twice the fundamental resonance frequency. In contrast, in Examples 2 to 4, the second-order resonance frequency was about three times as high as the fundamental frequency, and no resonance occurred at a frequency which is twice the fundamental resonance frequency.

TABLE 2

| | spiral rotating direction | | fundamental resonance | | second-order resonance | |
|---|---|---|---|---|---|---|
| | | | frequency | Q value | frequency | Q value |
| Example 2 | first layer | clockwise | 0.96 GHz | 66 | 3.00 GHz | 47 |
| | second layer | counter-clockwise | | | | |
| | third layer | clockwise | | | | |
| Example 3 | first layer | clockwise | 1.30 GHz | 68.9 | 2.73 GHz | 42.2 |
| | second layer | counter-clockwise | | | | |
| | third layer | counter-clockwise | | | | |
| Example 4 | first layer | clockwise | 1.25 GHz | 64.7 | 3.24 GHz | 44.1 |
| | second layer | clockwise | | | | |
| | third layer | counter-clockwise | | | | |
| Comparative Example 5 | first layer | clockwise | 2.52 GHz | 62.5 | 2.91 GHz | 42.4 |
| | second layer | clockwise | | | | |
| | third layer | clockwise | | | | |

(Example of the Third Embodiment)

Figure 18:
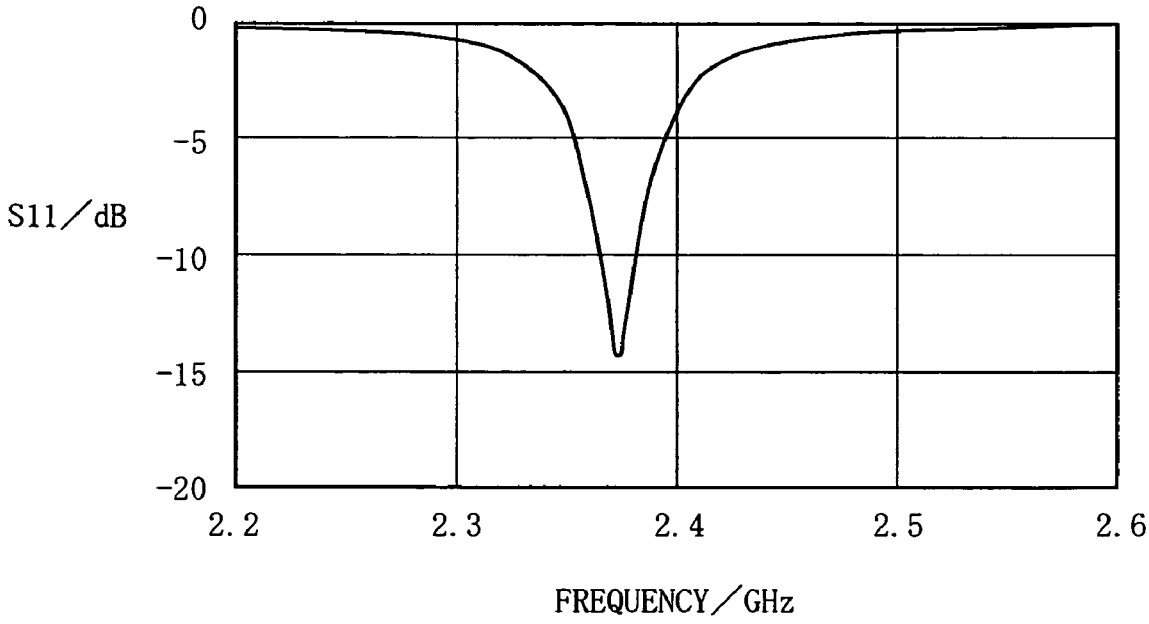
FIG. 18 is a graph showing frequency characteristics of the reflection intensity of a high-frequency circuit as an example of the third embodiment in which a spiral conductive strip is directly connected to an input/output line, in the case where power is supplied from the input/output line.

An example of the high-frequency circuit according to the third embodiment was constructed on a base substrate, which was an RT/Duroid substrate (dielectric constant 10.2, dielectric loss tangent 0.003) having a thickness of 640 microns. The high-frequency circuit was structured in the form of a two-layered dielectric substrate, with an additional substrate being stacked on the base substrate. The additional substrate was composed of the same material as the base substrate, and had a thickness of 130 microns. On the surface and at the internal conductive layer, two layers of spiral conductive strips were provided. Each spiral conductive strip was composed of a copper pattern having a conductor width of 200 microns, an inter-strip distance (within the same plane) of 200 microns, a conductor thickness of 40 microns, and was shaped so as to have a square outermost contour of 900 microns by 900 microns, having 1.5 turns. Thus, a stacked spiral conductive strip resonator was constructed. On the uppermost surface of the multilayered dielectric substrate, an input/output line having a width of 400 microns was formed. FIG. 18 is a graph showing frequency characteristics of the reflection intensity of a high-frequency circuit as an example of the third embodiment in which a spiral conductive strip is directly connected to the input/output line, in the case where power is supplied from the input/output line. A copper piece which was attached across the entire back face of the multilayered dielectric substrate was allowed to function as a high-frequency ground. A junction point 13 was provided in the same relative position with respect to the upper spiral conductive strip as shown in FIG. 10B.

As shown in FIG. 18, a high-intensity reflection peak was obtained with a reflection loss of 14 dB, without affecting the fundamental resonance frequency of 2.37 GHz. Thus, it was confirmed that there was a strong coupling between the stacked spiral conductive strip resonator and the external circuit.

Figure 19A:
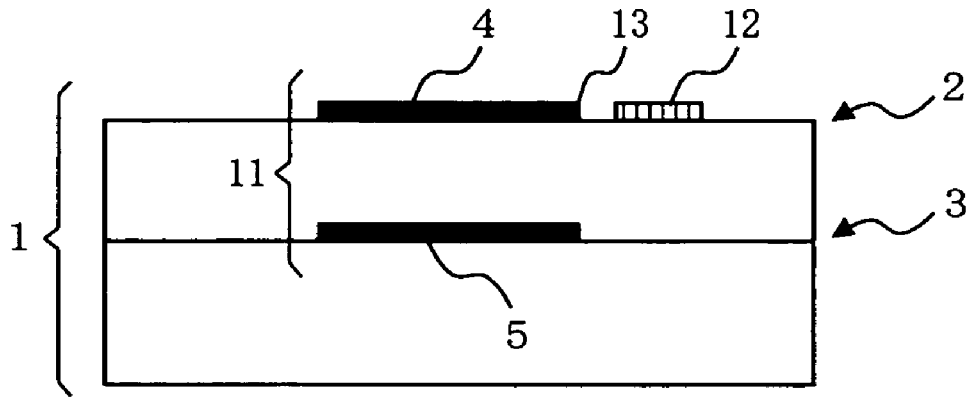
FIG. 19A is a schematic cross-sectional view illustrating a high-frequency circuit in which the orientation of an input/output line 12 is rotated by 90° with respect to an outermost strip of a spiral conductive strip 4 so as to together function as parallel coupled-lines which are 200 microns apart.
Figure 19B:
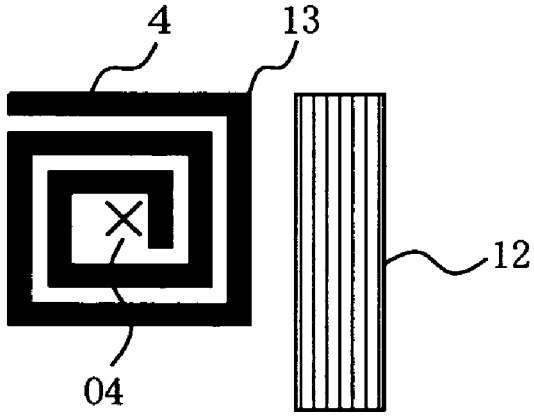
FIG. 19B is an upper plan view showing patterns of the spiral conductive strip 4 and the input/output line 12 in the high-frequency circuit shown in FIG. 19A.
Figure 19C:
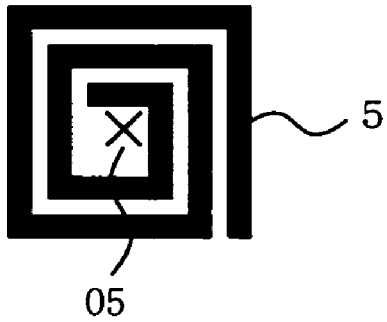
FIG. 19C is an upper plan view showing a pattern of a spiral conductive strip 5 in the high-frequency circuit shown in FIG. 19A.

A comparative example was constructed under the same conditions as those for the above high-frequency circuit, except for providing an interspace of 200 microns between the input/output line (width: 400 microns) and the stacked spiral conductive strips, and power was supplied. In this case, under the limits of measurement accuracy for reflection intensity, no peak could be confirmed in the reflection characteristics. Thus, it was confirmed that merely reducing the coupling distance would not provide for a strong coupling with the stacked spiral conductive strip resonator. Then, as shown in FIGS. 19A to 19C, the orientation of the input/output line 12 was rotated by 90° relative to the outermost strip spiral conductive strip 4, so that, functionally-speaking, parallel coupled-lines with an inter-line distance of 200 microns were obtained. The neighborhood of the junction point 13 was utilized as an open terminating end, and power was supplied. As a result, the reflection loss at the resonance frequency was only 0.55 dB. Thus, it was confirmed that merely reducing the coupling distance would not provide for a strong coupling with the stacked spiral conductive strip resonator.

(Example of the Fourth Embodiment)

Figure 20:
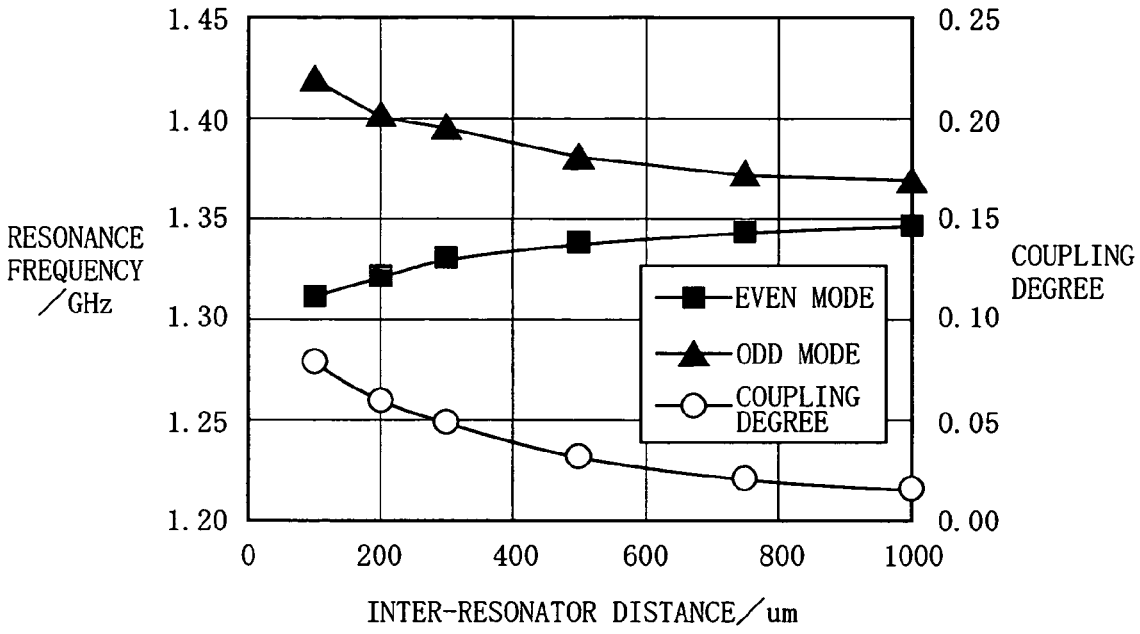
FIG. 20 is a graph showing changes in the coupling degree when the distance between two resonators is changed.

An example of the high-frequency circuit according to the fourth embodiment was constructed on a base substrate, which was an RT/Duroid substrate (dielectric constant 10.2, dielectric loss tangent 0.003) having a thickness of 640 microns. The high-frequency circuit was structured in the form of a two-layered dielectric substrate, with an additional substrate being stacked on the base substrate. The additional substrate was composed of the same material as the base substrate, and had a thickness of 130 microns. On the surface and at the internal conductive layer, two layers of spiral conductive strips were provided. Each spiral conductive strip was composed of a copper pattern having a conductor width of 200 microns, an inter-strip distance (within the same plane) of 200 microns, a conductor thickness of 40 microns, and was shaped so as to have a square outermost contour of 2500 microns by 2500 microns, having 2.5 turns. The inventors assessed a coupling degree between two stacked spiral conductive strip resonators which are disposed apart from each other that is based on separation in fundamental resonance frequencies of the stacked spiral conductive strip resonators. A copper piece which was attached across the entire back face of the multilayered dielectric substrate was allowed to function as a high-frequency ground. The coupling degree between coupled resonators can be calculated based on how much of the fundamental resonance frequency is split to the even mode and the odd mode. FIG. 20 is a graph showing changes in the coupling degree when the distance between the two resonators is changed. FIG. 20 also shows changes in the two resonance frequencies for the even mode and the odd mode which resulted from separation from the fundamental resonance frequency due to coupling.

For example, if a band-pass filter having Chebyshev characteristics with a specific bandwidth of 5% and an intra-band insertion loss deviation of 0.2 dB were to be constructed from three layers of resonators, the coupling degree between resonators would be 0.0424. If the specific bandwidth is 10%, then a coupling degree of 0.0848 would theoretically be required in the case where there is an intra-band insertion loss deviation of 0.2 dB. However, as is clear from FIG. 20, it was confirmed from the example of the fourth embodiment that, by adjusting the distance between the two stacked spiral conductive strip resonators, a coupling degree which would be required in a practical filter design can be realized between the stacked spiral conductive strip resonators, each of which is a compact resonator.

(Example of the Fifth Embodiment)

As an example of the fifth embodiment, a first band-pass filter incorporating two stacked spiral conductive strip resonators was constructed on a base substrate, which was an RT/Duroid substrate (dielectric constant 10.2, dielectric loss tangent 0.003) having a thickness of 640 microns. The high-frequency circuit was structured in the form of a two-layered dielectric substrate, with an additional substrate being stacked on the base substrate. The additional substrate was composed of the same material as the base substrate, and had a thickness of 130 microns. Two stacked spiral conductive strip resonators were constructed by providing two layers of spiral conductive strips: one on the surface and one at the internal conductive layer. Each spiral conductive strip was composed of a copper pattern having a conductor width of 200 microns, an inter-strip distance (within the same plane) of 200 microns, a conductor thickness of 40 microns, and was shaped so as to have a square outermost contour of 1800 microns by 1800 microns, having 1.5 turns. The distance between the stacked spiral conductive strip resonators was set to be 300 microns, which corresponds to a coupling degree of 0.07, which is necessary for obtaining a specific bandwidth of 6%. The respective upper spiral conductive strips of the two stacked spiral conductive strip resonators had the same rotating direction, and the respective lower spiral conductive strips of the two stacked spiral conductive strip resonators had the same rotating direction. To the outermost strip subportion of the upper spiral conductive strip of each stacked spiral conductive strip resonator, a coplanar input/output line having a width of 400 microns was directly connected for realizing coupling between an external circuit and the resonator structure. Each junction point was defined at a portion which was away, by one side of the square, from the neighborhood of the open terminating end of the outermost strip subportion of the spiral conductive strip. A copper piece which was attached across the entire back face of the multilayered dielectric substrate was allowed to function as a high-frequency ground.

Figure 21:
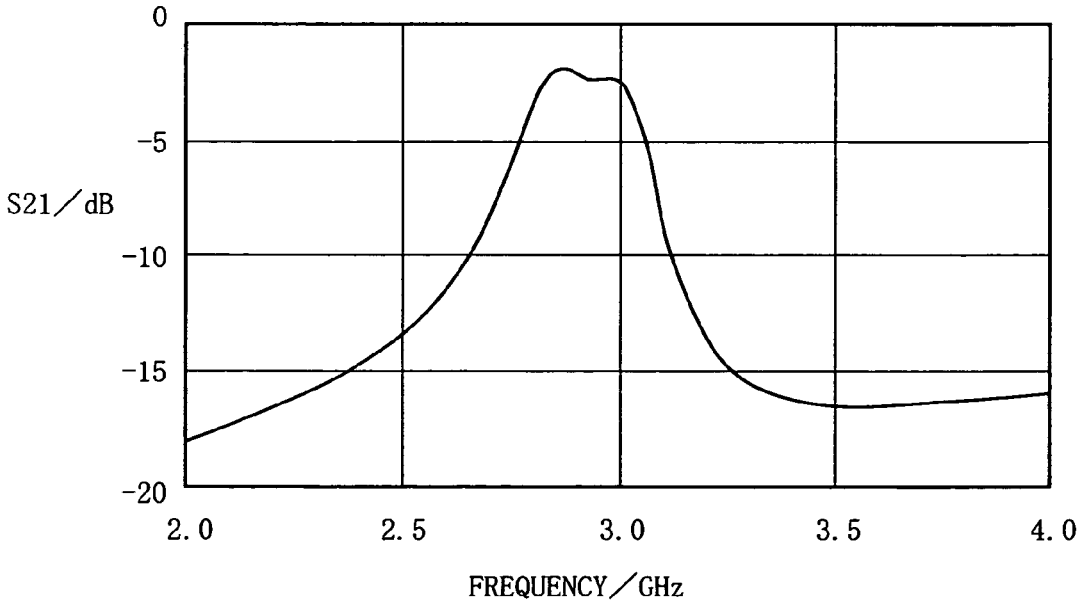
FIG. 21 is a graph showing passing characteristics of a first band-pass filter as an example of the fifth embodiment.
Figure 22:
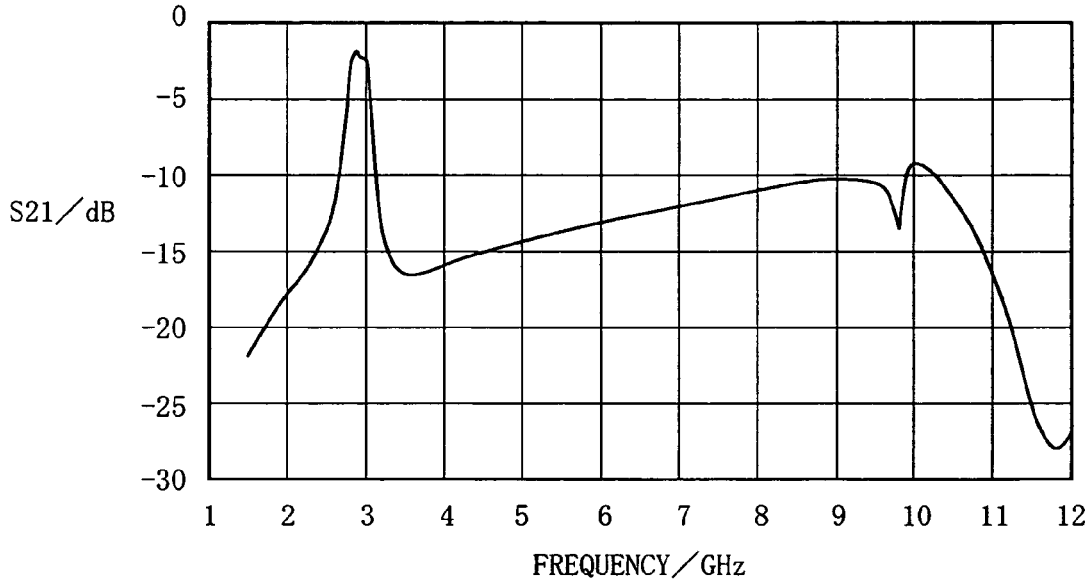
FIG. 22 is a graph showing passing characteristics of the first band-pass filter as an example of the fifth embodiment.

FIGS. 21 and 22 are graphs showing passing characteristics of the first band-pass filter. FIG. 21 shows the characteristics in a narrow region near the pass band. FIG. 22 shows the characteristics in a broader region up to a frequency (12 GHz) corresponding to four times the pass band. As shown in FIG. 21, a filter having a central frequency of 2.95 GHz and a specific bandwidth of 5.9% was realized. The minimum value of the insertion loss in the pass band was 1.8 dB. As is clear from FIG. 22, no unnecessary pass band was found in the frequency band near 6 GHz, which is twice as high as the central frequency.

In a similar manner, a second band-pass filter incorporating two stacked spiral conductive strip resonators was constructed on a base substrate, which was an RT/Duroid substrate (dielectric constant 10.2, dielectric loss tangent 0.003) having a thickness of 640 microns. The high-frequency circuit was structured in the form of a three-layered dielectric substrate, with two additional substrates being stacked on the base substrate. The additional substrates were composed of the same material as the base substrate, and had a thickness of 130 microns. Two stacked spiral conductive strip resonators were constructed by providing three layers of spiral conductive strips: one on the surface and two at the internal conductive layers. Each spiral conductive strip was composed of a copper pattern having a conductor width of 200 microns, an inter-strip distance (within the same plane) of 200 microns, a conductor thickness of 40 microns, and was shaped so as to have a square outermost contour of 1700 microns by 1700 microns, having 2 turns. In other words, the second band-pass filter is a variant of the first band-pass filter, where three stacked spiral conductive strip resonators are layered, instead of two. The distance between the stacked spiral conductive strip resonators was set to be 650 microns, which corresponds to a coupling degree of 0.06, which is necessary for obtaining a specific bandwidth of 5%. The respective upper spiral conductive strips of the two stacked spiral conductive strip resonators had the same rotating direction, and the respective lower spiral conductive strips of the two stacked spiral conductive strip resonators had the same rotating direction. To the outermost strip subportion of the upper spiral conductive strip of each stacked spiral conductive strip resonator, a coplanar input/output line having a width of 400 microns was directly connected for realizing coupling between an external circuit and the resonator structure. Each junction point was defined at a portion which was away, by one side of the square, from the neighborhood of the open terminating end of the outermost strip subportion of the spiral conductive strip. A copper piece which was attached across the entire back face of the multilayered dielectric substrate was allowed to function as a high-frequency ground.

Figure 23:
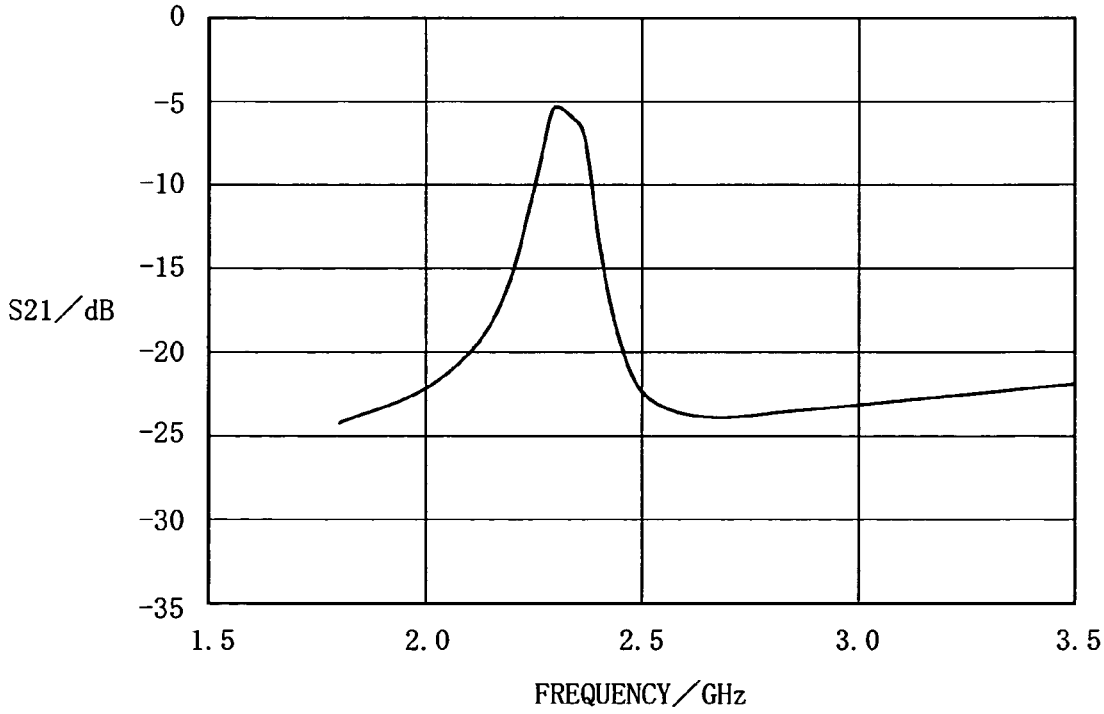
FIG. 23 is a graph showing passing characteristics of a second band-pass filter as an example of the fifth embodiment.
Figure 24:
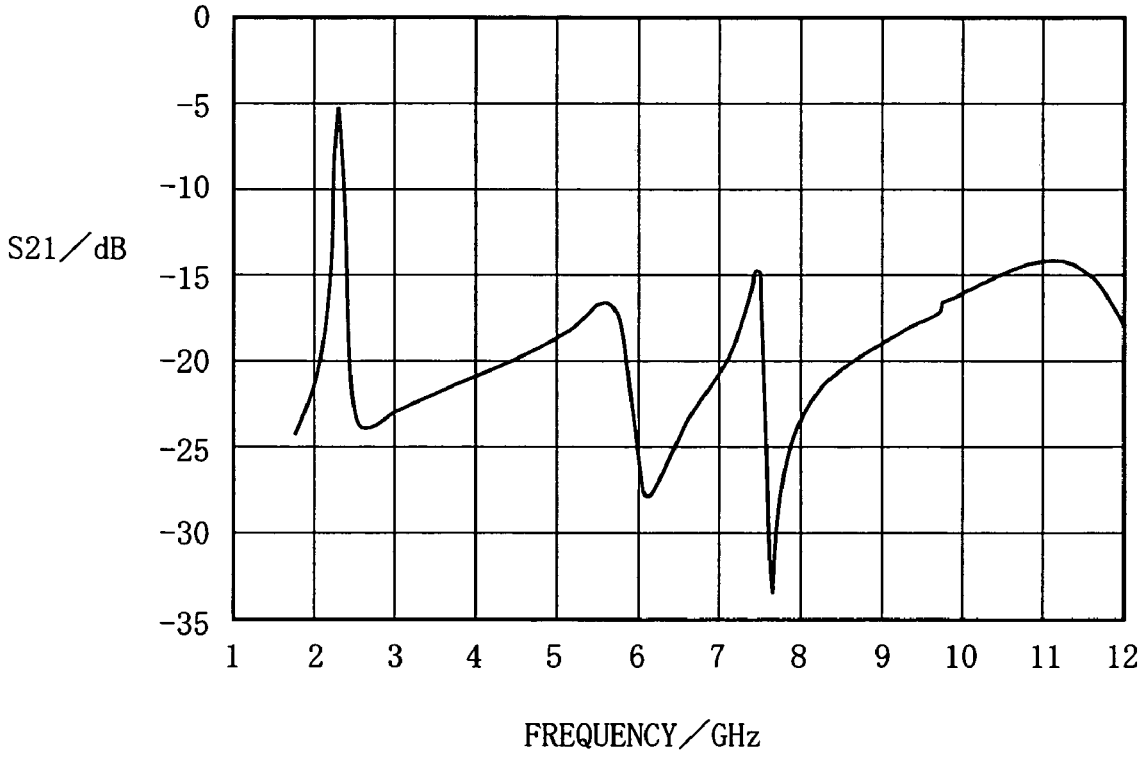
FIG. 24 is a graph showing passing characteristics of a second band-pass filter as an example of the fifth embodiment.
Figure 25A:
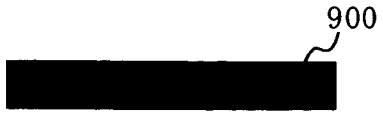
FIG. 25A PRIOR ART
FIG. 25A is an upper plan view showing a conventional ½ wavelength resonator.
Figure 25B:
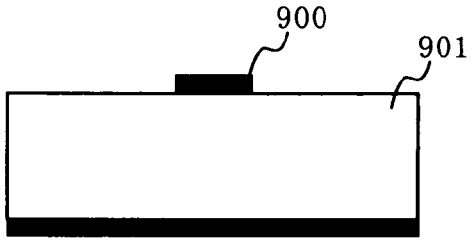
FIG. 25B PRIOR ART
FIG. 25B is a cross-sectional view showing a conventional ½ wavelength resonator shown in FIG. 25A.
Figure 26A:
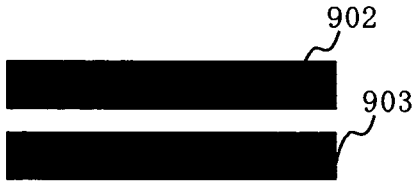
FIG. 26A PRIOR ART
FIG. 26A is an upper plan view showing a conventional resonator in which two resonators are electromagnetically coupled together.
Figure 26B:
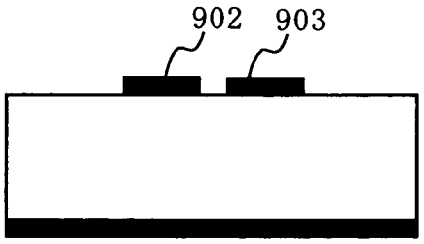
FIG. 26B PRIOR ART
FIG. 26B is a cross-sectional view of the conventional resonator shown in FIG. 26A composed of two electromagnetically coupled resonators.
Figure 27:
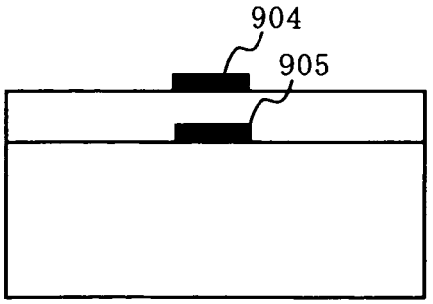
FIG. 27 PRIOR ART
FIG. 27 is a cross-sectional view showing a conventional resonator having an enhanced coupling degree, in which two transmission lines 904 and 905 are disposed in multiple layers so as to overlap each other in the thickness direction.

FIGS. 23 and 24 are graphs showing passing characteristics of the second band-pass filter. FIG. 23 shows the characteristics in a narrow region near the pass band. FIG. 24 shows the characteristics in a broader region up to a frequency (12 GHz) corresponding to five times the pass band. As shown in FIG. 23, a filter having a central frequency of 2.38 GHz and a specific bandwidth of 3.1% was realized. The minimum value of the insertion loss in the pass band was 5.0 dB. No unnecessary pass band was found in the frequency band near 4.8 GHz, which is twice as high as the central frequency.

Thus, the significant effects of the present invention have been indicated through comparisons in characteristics between conventional high-frequency circuits, Comparative Examples, and Examples of the high-frequency circuits according to the present invention.

The high-frequency circuit according to the present invention is a highly-functional resonator which is more compact than conventionally, and which can be constructed based on a simple structure without requiring any special material. The high-frequency circuit according to the present invention does not exhibit resonance at a frequency which is twice the fundamental resonance frequency, and structured in a size which is much shorter than the wavelength of electromagnetic waves of a transmission band, and therefore is useful for wireless communication devices and the like.

While the invention has been described in detail, the foregoing description is in all aspects illustrative and not restrictive. It is understood that numerous other modifications and variations can be devised without departing from the scope of the invention.

What is claimed is:

1. A resonator comprising a multilayered dielectric substrate including:

a first spiral conductive strip composed of a conductive strip having at least one turn; and a second spiral conductive strip composed of a conductive strip having at least one turn, wherein the first spiral conductive strip is not in electrical conduction with the second spiral conductive strip, the first spiral conductive strip and the second spiral conductive strip are located at different levels and overlap each other, the first spiral conductive strip has a rotating direction opposite to a rotating direction of the second spiral conductive strip, ends of the first spiral conductive strip are open and not connected to a terminal or other device, and ends of the second spiral conductive strip are open and not connected to a terminal or other device.

2. The resonator according to claim 1, wherein, when the first and second spiral conductive strips are stacked so that spiral centers of the first and second spiral conductive strips coincide with each other, outer peripheries of the first and second spiral conductive strips coincide with each other.

3. The resonator according to claim 1, wherein the open ends of outermost strip subportions of the first and second spiral conductive strips are disposed diagonally opposite from each other with respect to spiral centers of the first and second spiral conductive strips.

4. The resonator according to claim 1, further comprising an input/output line coupled to an outermost strip subportion of either one of the first and second spiral conductive strips.

5. The resonator according to claim 1, wherein the multilayered dielectric substrate further includes a third spiral conductive strip composed of a conductive strip having at least one turn, the third spiral conductive strip is not in electrical conduction with the first spiral conductive strip or the second spiral conductive strip, the third spiral conductive strip and each one of the first and second spiral conductive strips are located at different levels and overlap each other, the second spiral conductive strip is interposed between the first spiral conductive strip and the third spiral conductive strip, the second spiral conductive strip has the rotating direction opposite to a rotating direction of the third spiral conductive strip, and ends of the third conductive strip are open.

6. The resonator according to claim 5, wherein, when the first, second, and third spiral conductive strips are stacked so that spiral centers of the first, second, and third spiral conductive strips coincide with each other, outer peripheries of the first, second, and third spiral conductive strips coincide with each other.

7. The resonator according to claim 5, wherein the open ends of outermost strip subportions of the first and second spiral conductive strips are disposed diagonally opposite from each other with respect to spiral centers of the first and second spiral conductive strips, and the open ends of outermost strip subportions of the second and third spiral conductive strips are disposed diagonally opposite from each other with respect to the spiral center of the second spiral conductive strip and a spiral center of the third spiral conductive strip.

8. The resonator according to claim 1, wherein the multilayered dielectric substrate further includes:

a third spiral conductive strip composed of a conductive strip having at least one turn, the third spiral conductive strip adjoining the first spiral conductive strip in a lateral direction and having a same rotating direction as that of the first spiral conductive strip; and a fourth spiral conductive strip composed of a conductive strip having at least one turn, the fourth spiral conductive strip adjoining the second spiral conductive strip in a lateral direction and having a same rotating direction as that of the second spiral conductive strip, the third spiral conductive strip is not in electrical conduction with the fourth spiral conductive strip, the third spiral conductive strip and the fourth spiral conductive strip are located at different levels and overlap each other, the third spiral conductive strip has a rotating direction opposite to a rotating direction of the fourth spiral conductive strip, ends of the third spiral conductive strip are open, and ends of the fourth spiral conductive strip are open.

9. The resonator according to claim 8, wherein, when the first and second spiral conductive strips are stacked so that spiral centers of the first and second spiral conductive strips coincide with each other, outer peripheries of the first and second spiral conductive strips coincide with each other, and when the third and fourth spiral conductive strips are stacked so that spiral centers of the third and fourth spiral conductive strips coincide with each other, outer peripheries of the third and fourth spiral conductive strips coincide with each other.

10. The resonator according to claim 8, wherein the open ends of outermost strip subportions of the first and second spiral conductive strips are disposed diagonally opposite from each other with respect to spiral centers of the first and second spiral conductive strips, and the open ends of outermost strip subportions of the third and fourth spiral conductive strips are disposed diagonally opposite from each other with respect to spiral centers of the third and fourth spiral conductive strips.

11. The resonator according to claim 1, wherein a current distribution density at the open ends of the first spiral conductive strip is 0, and a current distribution density at the open ends of the second spiral conductive strip is 0.

12. The resonator according to claim 5, further comprising an input/output line coupled to an outermost strip subportion of any of the first, second, and third spiral conductive strips, wherein the input/output line is connected to a portion other than the open ends of the any of the first, second, and third spiral conductive strips.

13. The resonator according to claim 5, further comprising an input/output line coupled to an outermost strip subportion of any of the first, second, and third spiral conductive strips, wherein the input/output line is separated from and not electrically connected to the first, second, and third spiral conductive strips.

14. The resonator according to claim 8, further comprising a plurality of input/output lines coupled to outermost strip subportions of any of the first, second, third, and fourth spiral conductive strips, wherein the input/output lines are connected to portions other than the open ends of the any of the first, second, third, and fourth spiral conductive strips.

15. The resonator according to claim 8, further comprising a plurality of input/output lines coupled to outermost strip subportions of any of the first, second, third, and fourth spiral conductive strips, wherein the input/output lines are separated from and not electrically connected to the first, second, third, and fourth spiral conductive strips.

16. The resonator according to claim 1, wherein the resonator is operable to inhibit exhibition of resonance at a frequency which is twice as high as a fundamental frequency, and exhibit resonance at a frequency which is a multiple, of an integer equal to or greater than 3, of the fundamental frequency.

* * * * *